US012048859B1

(12) United States Patent
He et al.

(10) Patent No.: US 12,048,859 B1
(45) Date of Patent: Jul. 30, 2024

(54) FITNESS DEVICES AND METHODS FOR SWITCHING TRAINING MODES THEREOF

(71) Applicant: SHENZHEN THOUSANDSHORES TECHNOLOGY CO., LTD., Guangdong (CN)

(72) Inventors: Ding He, Shenzhen (CN); Zhi Liu, Shenzhen (CN); Hui Xu, Shenzhen (CN)

(73) Assignee: SHENZHEN THOUSANDSHORES TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 18/477,524

(22) Filed: Sep. 28, 2023

(30) Foreign Application Priority Data

Sep. 11, 2023 (CN) ..... 202311169097.4
Sep. 11, 2023 (CN) ..... 202311171082.1

(51) Int. Cl.
*A63B 21/00* (2006.01)
*A63B 21/005* (2006.01)

(52) U.S. Cl.
CPC .... *A63B 21/00069* (2013.01); *A63B 21/0058* (2013.01); *A63B 21/15* (2013.01); *A63B 2220/803* (2013.01); *A63B 2225/66* (2013.01)

(58) Field of Classification Search
CPC ..... A63B 21/00069; A63B 21/0058; A63B 21/15; A63B 2220/803; A63B 2225/66
See application file for complete search history.

(56) References Cited

U.S. PATENT DOCUMENTS

| | | | | |
|---|---|---|---|---|
| 10,307,631 | B2 * | 6/2019 | Jeremic | A63B 22/0076 |
| 10,350,446 | B2 * | 7/2019 | Simonetti | A63B 23/0429 |
| 2022/0062691 | A1 * | 3/2022 | Kao | A63B 21/157 |
| 2022/0111241 | A1 * | 4/2022 | Moyer | A63B 21/154 |
| 2022/0161088 | A1 * | 5/2022 | Wilson | A63B 23/03541 |

OTHER PUBLICATIONS

"FitTransformer: All-In-One Modular Home Gym", Web page <https://www.kickstarter.com/projects/2484918/fittransformer-one-stop-modular-home-gym-of-the-future?ref=discovery&term=sportneer>, Jul. 13, 2023, 37 pages.

* cited by examiner

*Primary Examiner* — Andrew S Lo
*Assistant Examiner* — Andrew M Kobylarz
(74) *Attorney, Agent, or Firm* — Porus IP LLC

(57) ABSTRACT

Some embodiments of the present disclosure provide fitness devices and methods for switching a training mode. The fitness device may include a resistance module and at least one type of fitness equipment. The resistance module may be detachably connected with the at least one type of fitness equipment. The resistance module may provide resistance to the at least one type of fitness equipment. The at least one type of fitness equipment may include a switching device to switching the training mode.

20 Claims, 25 Drawing Sheets

FITNESS DEVICES AND METHODS FOR SWITCHING TRAINING MODES THEREOF

CROSS-REFERENCE TO RELATED APPLICATIONS

This application claims priority of Chinese Patent Application No. 202311171082.1, filed on Sep. 11, 2023, and Chinese Patent Application No. 202311169097.4, filed on Sep. 11, 2023, the contents of each of which are entirely incorporated herein by reference.

TECHNICAL FIELD

The present disclosure relates to the field of fitness equipment, and in particular, to a fitness device and a method for switching a training mode of the fitness device.

BACKGROUND

Fitness equipment continues to evolve and innovate when meeting people's needs for health and fitness enhancement. The fitness equipment based on strength training is mainly powered by a slewing system of a motor system, and aerobic training and strength training are embodied by adjusting a motor speed, which may not achieve inertia feeling of traditional aerobic training. An aerobic mode of the fitness equipment (e.g., a rowing machine and a ski machine) primarily for aerobic training mainly adopts in the rebound of trace, and a power system of the fitness equipment continues to generate inertia. However, if a user switches between strength training and aerobic training, the corresponding fitness equipment is often switched, and it is impossible to achieve two different professional training modes in one equipment.

Therefore, it is desirable to provide a fitness device and a method for switching a training mode of the fitness device, which can switch different professional training modes as needed.

SUMMARY

One or more embodiments of the present disclosure provide a fitness device. The fitness device may include a resistance module and at least one type of fitness equipment. The resistance module may be detachably connected with the at least one type of fitness equipment. The resistance module may provide resistance to the at least one type of fitness equipment. The at least one type of fitness equipment may include a switching device configured to switch a training mode.

In some embodiments, one of the at least one type of fitness equipment may include a switching device configured to switch a training mode of the one of the at least one type of fitness equipment. The switching device may include a switching mechanism, a first connecting mechanism, and a second connecting mechanism. The switching mechanism may be drivingly connected with the first connecting mechanism or the second connecting mechanism. A connection between the first connecting mechanism and the switching mechanism may make the fitness equipment drivingly connected with a resistance module, the switching device may be in a first state, and the at least one type of fitness equipment may be in a first mode. A connection between the second connecting mechanism and the switching mechanism may make the fitness equipment drivingly connected with the resistance module, the switching device may be in a second state, and the at least one type of fitness equipment may be in a second mode.

In some embodiments, the switching mechanism may include at least one toggle assembly. Each of the at least one toggle assembly may include a support and a toggle member slidably disposed in the support, and the toggle member may be drivingly connected with the first connecting mechanism or the second connecting mechanism by sliding on the support.

In some embodiments, the support may include one or more positioning shafts. The one or more positioning shafts may include a first positioning shaft and a second positioning shaft. The first positioning shaft may be spaced apart from the second positioning shaft in an x-axis direction, and the first positioning shaft and the second positioning shaft may be spaced apart in a y-axis direction. The first positioning shaft may include a pair of first positioning sub-shafts coaxially disposed in a z-axis direction, and the second positioning shaft may include a pair of second positioning sub-shafts coaxially disposed in the z-axis direction. The toggle member may be slidably connected with the first positioning shaft and the second positioning shaft. The toggle member may move in the x-axis direction and the y-axis direction simultaneously when the toggle member slides along at least one of the first positioning shaft and the second positioning shaft.

In some embodiments, the toggle member may include a moving sleeve and a connecting member. The moving sleeve may be provided with a Z-groove, and the first positioning shaft and the second positioning shaft may be able to slide in the Z-groove. The connecting member may be drivingly connected with the first connecting mechanism and the switching device may be in the first state when both the first positioning shaft and the second positioning shaft are located in the Z-groove. The connecting member may be drivingly connected with the second connecting mechanism and the switching device may be in the second state when the second positioning shaft is located in the Z-groove.

In some embodiments, the first connecting mechanism may include a central gear assembly and a bevel gear, and the central gear assembly may include a fixed gear. The switching device may be in the first state by the toggle member sliding towards a first position for driving, through the connecting member, the bevel gear to mesh with the fixed gear.

In some embodiments, the second connecting mechanism may include a unidirectional wheelset, and the unidirectional wheelset may include a unidirectional gear. The switching device may be in the second state by the toggle member sliding toward a second position for driving the connecting member to mesh with the unidirectional gear.

In some embodiments, the fitness device may further include a pull wheel assembly. When the switching device is in the first state, the resistance module may be drivingly connected with the pull wheel assembly through the first connecting mechanism. When the switching device is in the second state, the resistance module may be drivingly connected with the pull wheel assembly through the second connecting mechanism.

In some embodiments, the resistance module may include a housing, a power device, and a transmission mechanism. The transmission mechanism may include a connecting shaft. The connecting shaft may be configured to drivingly connect the at least one type of fitness equipment, and the power device may provide resistance to the at least one type of fitness equipment through the connecting shaft.

In some embodiments, a handle may be disposed outside the housing. A fixed plate may be disposed inside the housing. The power device and the transmission mechanism may be mounted on the fixed plate, and a cooling fan may be disposed on the fixed plate.

In some embodiments, the power device may include a motor assembly, a resistor, and a controller.

In some embodiments, the power device may include a power source.

In some embodiments, the transmission mechanism may include a positioning shaft, and the connecting shaft may be concentric with a rotating shaft of a gantry of one of the at least one type of fitness equipment through the positioning shaft.

In some embodiments, the fitness device may further include a taper structure. The taper structure may be disposed outside the connecting shaft. The taper structure may match a mating structure disposed on the fitness equipment to make the connecting shaft concentric with a rotating shaft of a gantry of one of the at least one fitness equipment.

In some embodiments, the fitness device may further include a position sensor. The position sensor may be configured to monitor whether the resistance module reaches a preset mounting position.

In some embodiments, the fitness device may further include a distance sensor. The distance sensor may be configured to monitor a distance between an end face of the connecting shaft and an end face of a rotating shaft of a gantry of one of the at least one type of fitness equipment.

In some embodiments, the fitness device may further include a mounting structure configured to mounting the resistance module. The mounting structure may be disposed on each of the at least one type of fitness equipment, and the resistance module may be fixed relative to one of the at least one type of fitness equipment through the mounting structure.

In some embodiments, the mounting structure may include a first positioning assembly and/or a second positioning assembly. The first positioning assembly may include an L-shaped platen, an end of a transverse plate of the L-shaped platen may be provided with a snap hook structure for hooking the resistance module, and the L-shaped platen may be provided with a torsion spring. The second positioning assembly may include a convex plate and a mounting groove. One side of the convex plate may be a flat surface, and another side of the convex plate may have a protrusion. The convex plate may be rotatably disposed in the mounting groove to make the flat surface of the convex plate coplanar with a surface including a notch of the mounting groove, or the convex plate may protrude beyond the surface including the notch of the mounting groove.

One or more embodiments of the present disclosure provide a method for switching a training mode, applied to the fitness device as described above. The fitness equipment may further include a physiological monitoring device and a motion monitoring device. The method may include extracting a motion feature of a user based on motion data obtained by the motion monitoring device. The method may further include determining a motion state of the user based on the physiological monitoring data obtained by the physiological monitoring device and the motion feature. The method may further include determining whether to switch a training mode of one of at least one type of fitness equipment of the fitness device based on the motion state.

One or more embodiments of the present disclosure provide a fitness device. The fitness device may include a switching device configured to switch a training mode of the one of the at least one type of fitness equipment. The switching device may include a switching mechanism, a first connecting mechanism, and a second connecting mechanism. The switching mechanism may be drivingly connected with the first connecting mechanism or the second connecting mechanism. A connection between the first connecting mechanism and the switching mechanism may make the fitness equipment drivingly connected with a resistance module, the switching device may be in a first state, and the at least one type of fitness equipment may be in a first mode. A connection between the second connecting mechanism and the switching mechanism may make the fitness equipment drivingly connected with the resistance module, the switching device may be in a second state, and the at least one type of fitness equipment may be in a second mode.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1A:
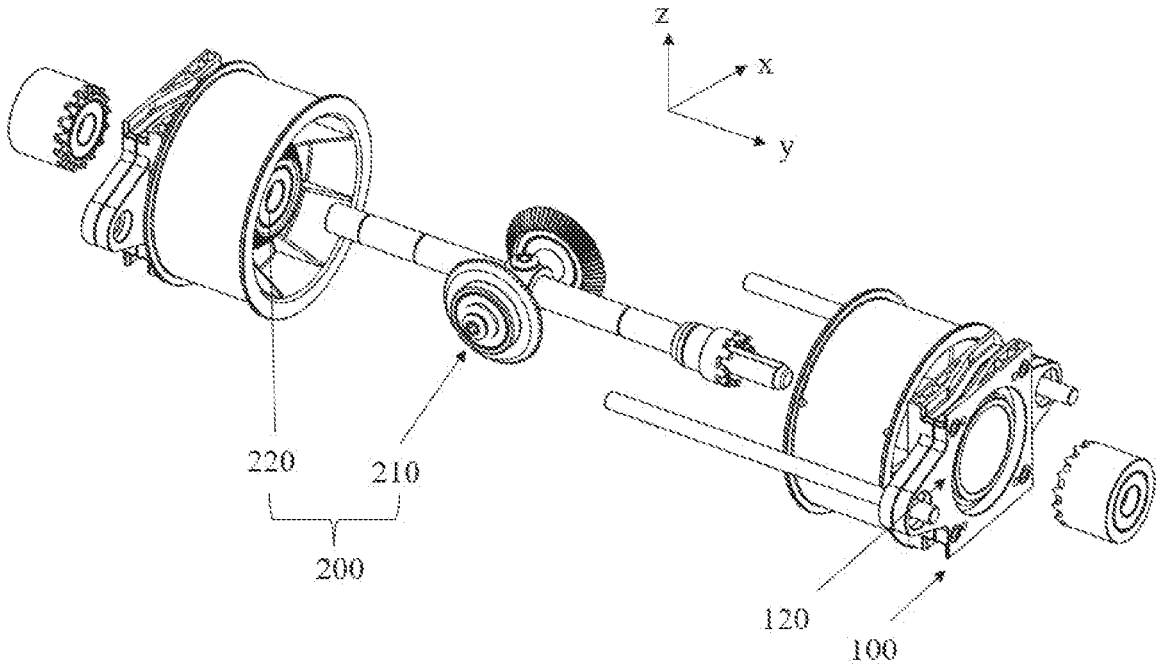
FIG. 1A is an explosion structural diagram illustrating an exemplary switching device according to some embodiments of the present disclosure.

In order to more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

It should be understood that the "system," "device," "unit," and/or "module" used herein are one method to distinguish different components, elements, parts, sections, or assemblies of different levels. However, if other words can achieve the same purpose, the words can be replaced by other expressions.

As used in the disclosure and the appended claims, the singular forms "a," "an," and "the" include plural referents unless the content clearly dictates otherwise; the plural forms may be intended to include singular forms as well. In general, the terms "comprise," "comprises," and/or "comprising," "include," "includes," and/or "including," merely prompt to include steps and elements that have been clearly identified, and these steps and elements do not constitute an exclusive listing.

A main goal of a strength training mode is to build muscle strength and muscle mass, and weight training equipment (e.g., a barbell, a dumbbell, or a strength-training station) is usually used for the strength training mode with high-intensity, low-repetition training. A main goal of an aerobic training mode is to enhance a cardio-pulmonary function and endurance, and aerobic equipment (e.g., a treadmill, a rowing machine, or a bicycle) is usually used for the aerobic training mode with low-intensity, high-repetition training to improve the cardio-pulmonary function and endurance. The strength training mode and the aerobic training mode correspond to different intensity requirements.

Some embodiments of the present disclosure provide a fitness device. The fitness device may include a resistance module and at least one type of fitness equipment. In some embodiments, the at least one type of fitness equipment may include a plurality of types of fitness equipment. The plurality of types of fitness equipment may include various fitness equipment (e.g., a strength training station or a rowing machine) belonging to different training modes, or may include various different fitness equipment (e.g., a treadmill or a rowing machine) belonging to the same training mode. In some embodiments, the resistance module may be detachably connected with the at least one type of fitness equipment, and the resistance module may provide resistance to the at least one type of fitness equipment. In some embodiments, the plurality of types of fitness equipment may be connected with a same resistance module. More descriptions regarding the resistance module may be found in the present disclosure below. In some embodiments, the at least one type of fitness equipment may include a switching device configured to switch a training mode of the at least one type of fitness equipment.

Figure 1B:
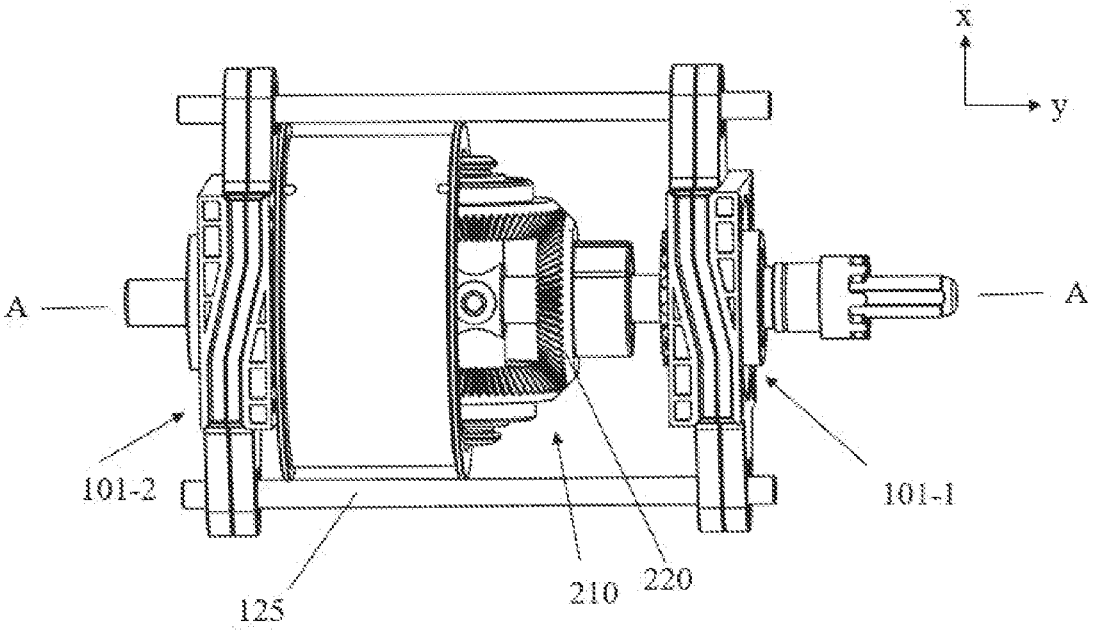
FIG. 1B is a structural diagram illustrating a top view of an exemplary switching device according to some embodiments of the present disclosure.
Figure 1C:
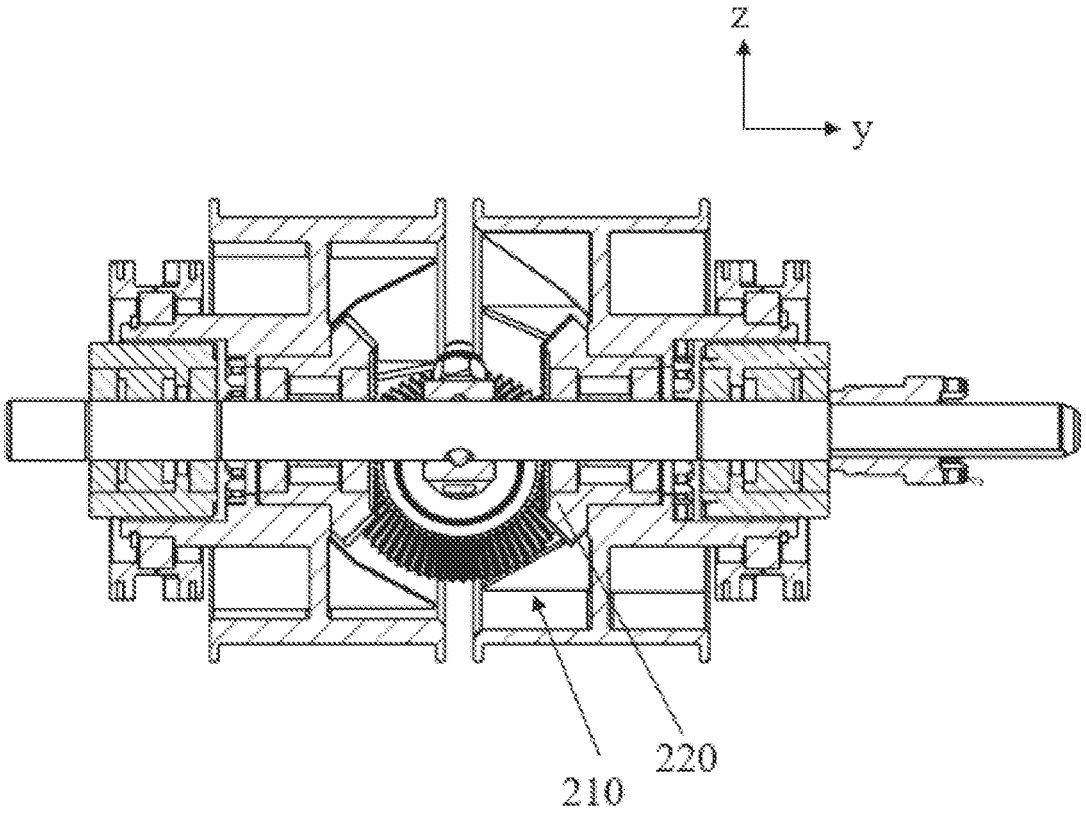
FIG. 1C is a diagram illustrating a cross-section of the switching device structure in an A-A direction of FIG. 1B according to some embodiments of the present disclosure.
Figure 2:
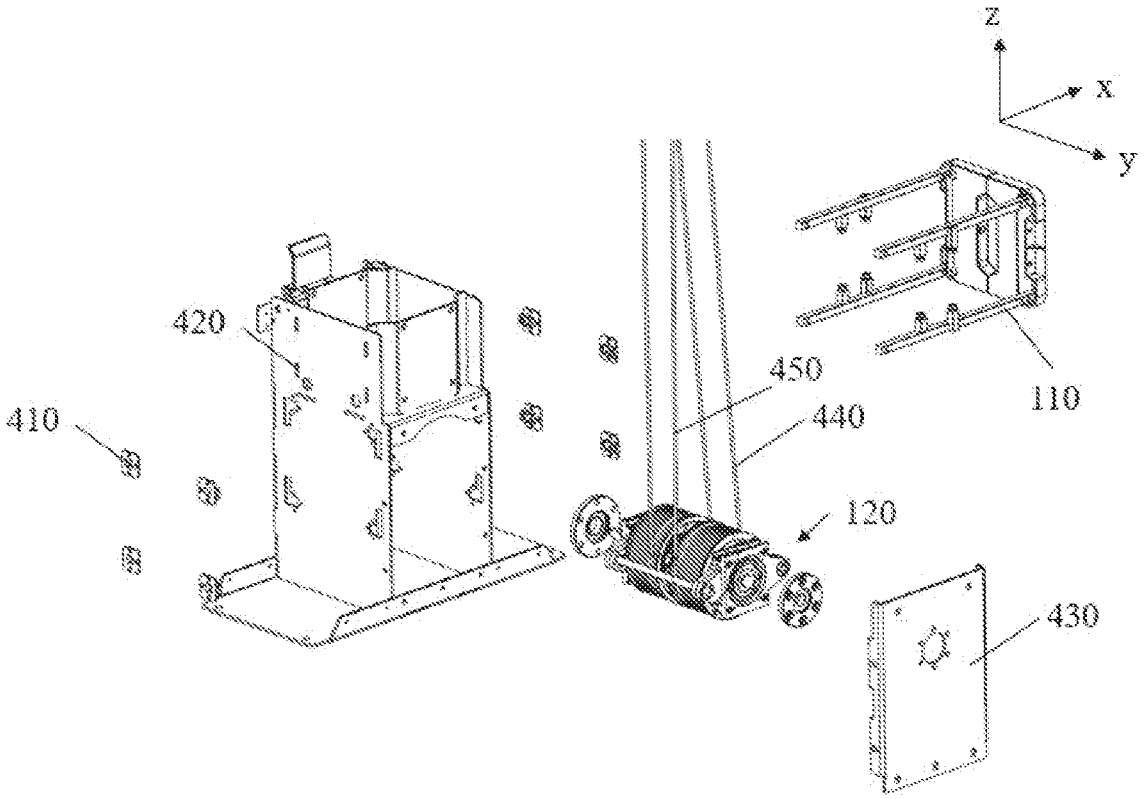
FIG. 2 is a diagram illustrating the mounting of an exemplary switching device according to some embodiments of the present disclosure.

FIG. 1A is an explosion structural diagram illustrating an exemplary switching device according to some embodiments of the present disclosure. FIG. 1B is a structural diagram illustrating a top view of an exemplary switching device according to some embodiments of the present disclosure. FIG. 1C is a diagram illustrating a cross-section of the switching device in an A-A direction of FIG. 1B according to some embodiments of the present disclosure. FIG. 2 is a diagram illustrating the mounting of an exemplary switching device according to some embodiments of the present disclosure.

The switching device for switching a training mode of at least one type of fitness equipment (hereinafter referred to as fitness equipment) may be capable of switching a state. For example, the switching device for switching a training mode of at least one type of fitness equipment may switch between a first state and a second state. The switching device may include a switching mechanism, a first connecting mechanism, and a second connecting mechanism. The switching mechanism may be configured to switch a training mode of the fitness equipment by switching the state of the switching device between the first state and the second state. The switching mechanism may be drivingly connected with the first connecting mechanism or the second connecting mechanism. In some embodiments, the switching device may be in a first state by a connection between the first connecting mechanism and the switching mechanism. The switching device may be in a second state by the connection between the second connecting mechanism and the switching mechanism.

Figure 4:
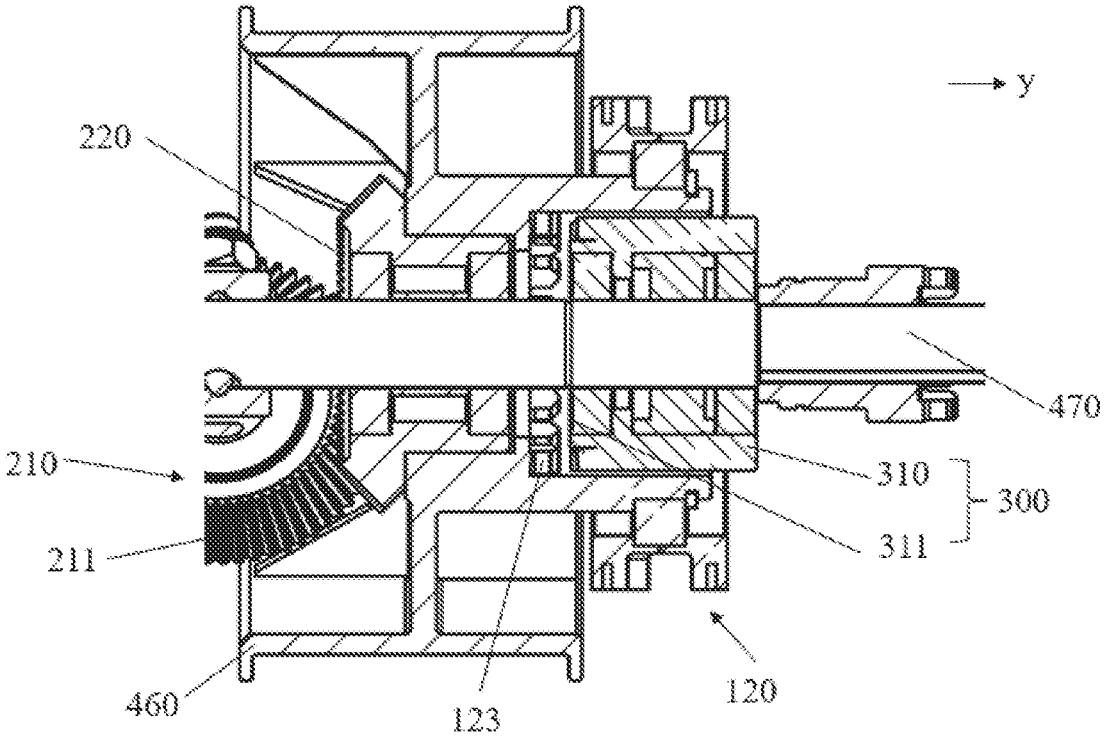
FIG. 4 is a diagram illustrating an exemplary partial structure of FIG. 1C according to some embodiments of the present disclosure.
Figure 6:
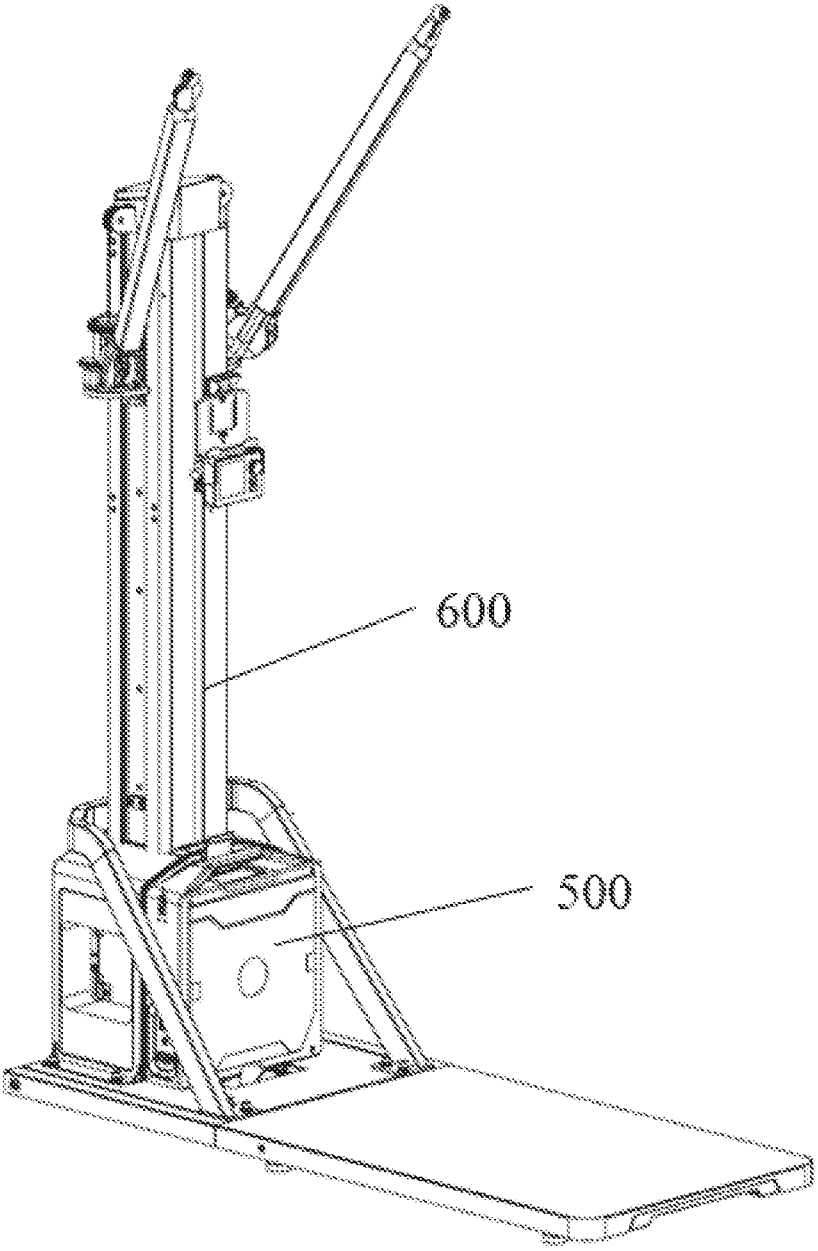
FIG. 6 is a structural diagram illustrating an exemplary fitness equipment according to some embodiments of the present disclosure.

For example, as shown in FIG. 1A-FIG. 1C, and FIG. 4, the switching device may include a switching mechanism 100, a first connecting mechanism 200, and a second connecting mechanism 300 (see FIG. 4). The switching mechanism 100 may be configured to switch a training mode of the fitness equipment (e.g., the fitness equipment 600 as shown in FIG. 6) by switching the state. The switching mechanism 100 may be drivingly connected with the first connecting mechanism 200 or the second connecting mechanism 300. In some embodiments, a connection between the first connecting mechanism 200 and the switching mechanism 100 may make the fitness equipment drivingly connected with a resistance module (e.g., a resistance module 500 as shown in FIG. 6), and the switching device may be in a first state. A connection between the second connecting mechanism 300 and the switching mechanism 100 may make the fitness equipment 600 drivingly connected with the resistance module 500, and the switching device may be in a second state.

In some embodiments, the switching mechanism 100 may be drivingly connected with the first connecting mechanism 200 or the second connecting mechanism 300 by an operator moves the switching mechanism 100 to be connected with the first connecting mechanism 200 or the second connecting mechanism 300 manually. In some embodiments, the switching mechanism 100 may be drivingly connected with the first connecting mechanism 200 or the second connecting mechanism 300 by driving the switching mechanism 100 using an electric device to be connected with the first connecting mechanism 200 or the second connecting mechanism 300 automatically. The switching mechanism 100 drivingly connected with the first connecting mechanism 200 or the second connecting mechanism 300 refers to that the switching mechanism 100 is connected with the first connecting mechanism 200 or the second connecting mechanism 300 via a transmission connection. The transmission connection may include a plurality of feasible forms, such as gear meshing transmission or connecting rod transmission. More descriptions regarding the transmission connection may be found in the present disclosure below.

The fitness equipment may provide a plurality of training modes for training. Different training modes may be related to training resistances provided by the fitness equipment. For example, the plurality of training modes may include a strength training mode and an aerobic training mode. The strength training mode may correspond to a first range of training resistance. The aerobic training mode may correspond to a second range of training resistance. In some embodiments, the maximum resistance of the first range of training resistance may be less than the minimum resistance of the second range of training resistance.

The resistance module may provide training resistance for training, and the resistance module may include a device such as a motor or a power source. In some embodiments, the first state of the switching device may correspond to a strength training mode of the fitness equipment, the resistance module may provide a large resistance, a user may need to resist a relatively large resistance during motion, and a training intensity may be high. The second state of the switching device may correspond to an aerobic training mode of the fitness equipment, the resistance module may provide a small resistance, the user may need to resist a relatively small resistance during motion, and the training intensity may be low. As described herein, the large resistance indicates that the resistance is greater than a first threshold. The small resistance indicates that the resistance is smaller than a second threshold. For the same fitness equipment, the first threshold is greater than or equal to the second threshold. In some embodiments, for different fitness equipment, the first threshold may be different or the same. In some embodiments, for different fitness equipment, the second threshold may be different or the same. In some embodiments, for the same fitness equipment, the first threshold and/or the second threshold may be set according to a user need.

Each of the first connecting mechanism 200 and/or the second connecting mechanism 300 may include a transmission structure, such as a turbine worm assembly, a gear set, etc. In some embodiments, the first connecting mechanism 200 and the second connecting mechanism 300 may include different transmission structures. For example, the first connecting mechanism 200 may include a turbine worm assembly and the second connecting mechanism 300 may include a gear set. In some embodiments, the first connecting mechanism 200 and the second connecting mechanism 300 may include the same transmission structure. For example, each of the first connecting mechanism 200 and the second connecting mechanism 300 may include a turbine worm assembly. In some embodiments, the first connecting mechanism 200 and the second connecting mechanism 300 may include the same transmission structure with different output parameters. For example, the first connecting mechanism 200 and the second connecting structure 300 may include the same transmission structure with different output torques and/or speeds. As another example, the first connecting mechanism 200 and the second connecting mechanism 300 may include turbine worms with different transmission ratios and output torques. As still another example, the first connecting mechanism 200 and the second connecting mechanism 300 may include gear sets with different transmission ratios and output torques, etc. Different training modes of a fitness equipment may be realized by different structural settings of the first connecting mechanism 200 and the second connecting mechanism 300. More descriptions regarding the training mode may be found in the present disclosure below.

The switching mechanism 100 may include at least one toggle assembly. Each of the at least one toggle assembly may include a support and a toggle member slidably disposed in the support. The toggle member may be drivingly connected with the first connecting mechanism 200 or the second connecting mechanism 300 by sliding on the support 110. More descriptions regarding a specific manner in which the toggle member is disposed may be found in the present disclosure below.

In some embodiments, the switching mechanism 100 may include two sets of toggle assemblies symmetrically disposed relative to the X-axis direction.

Figure 3A:
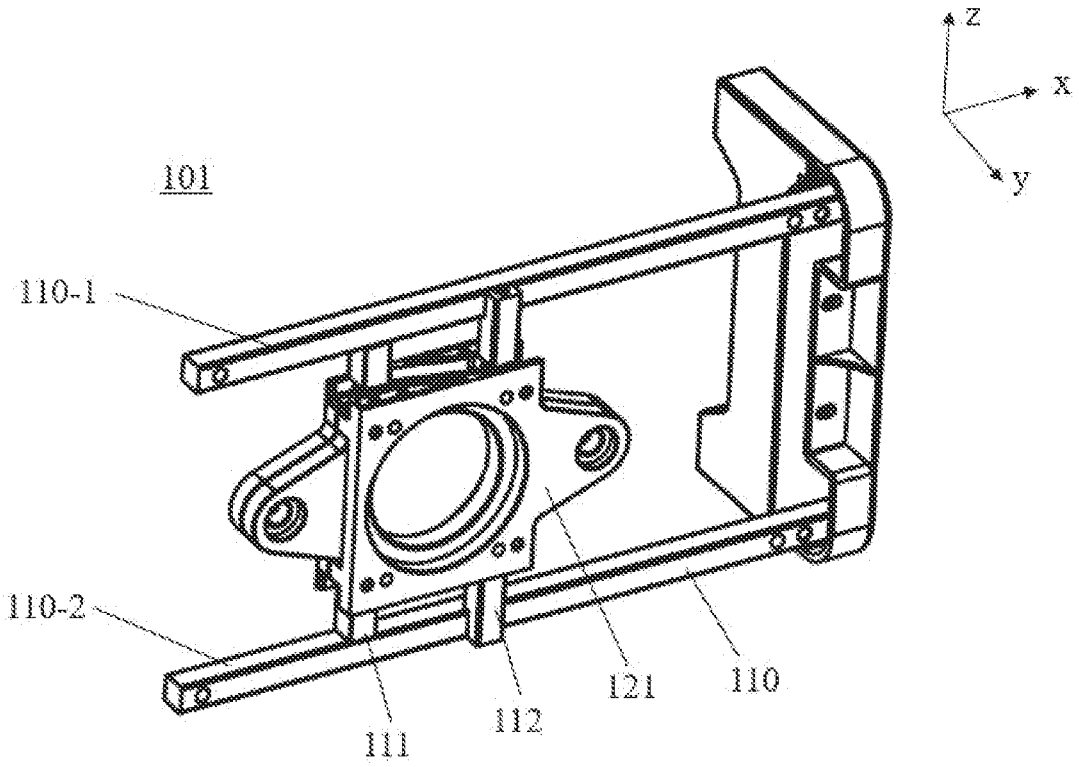
FIGS. 3A-3C are structural diagrams illustrating different states of the switching mechanism according to some embodiments of the present disclosure.
Figure 3B:
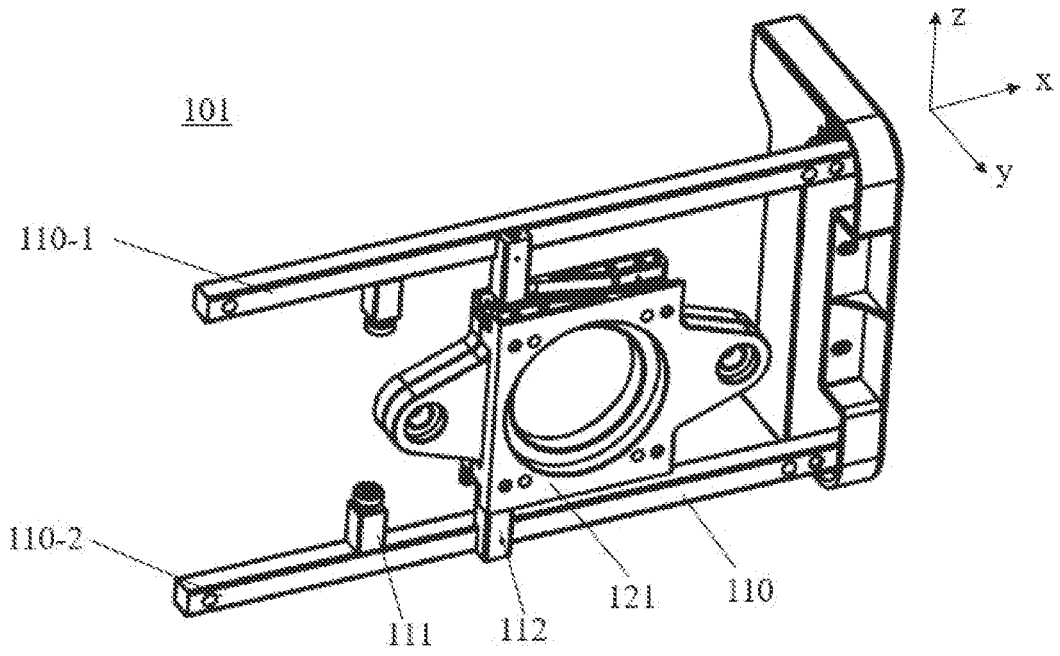
Figure 3C:
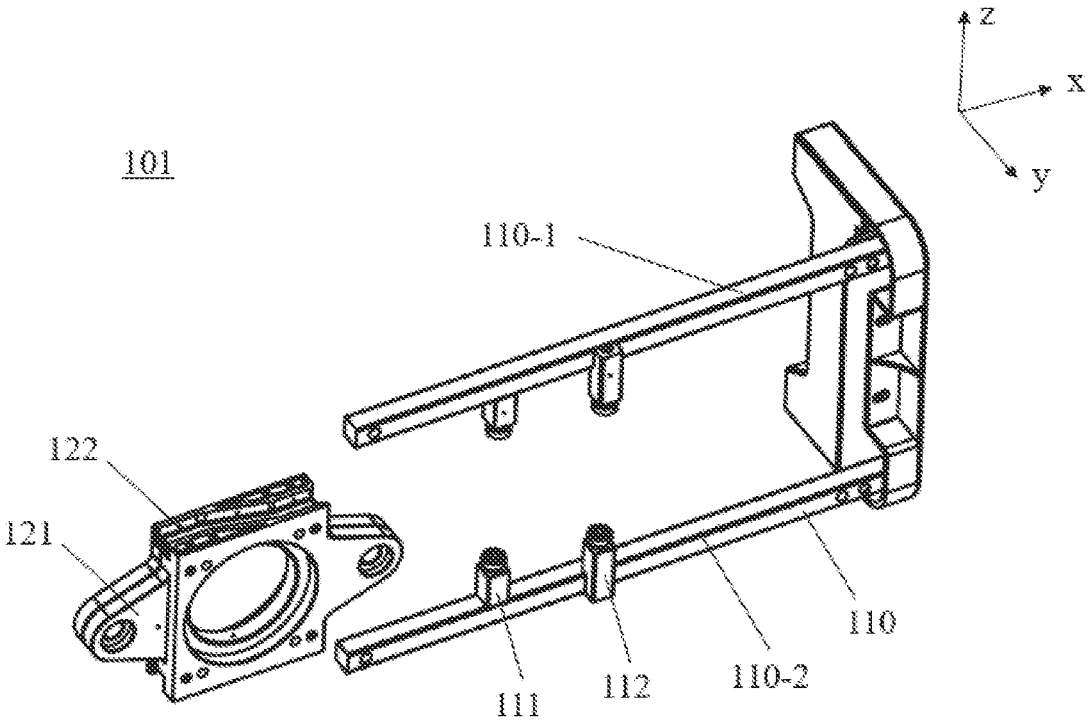

For example, FIGS. 3A-3C are structural diagrams illustrating different states of the switching mechanism according to some embodiments of the present disclosure. Combining FIG. 1A and FIGS. 3A-3C, the switching mechanism 100 may include at least one toggle assembly. Each of the at least one toggle assembly may include a support 110 and a toggle member 120 slidably disposed in the support. The toggle member 120 may be drivingly connected with the first connecting mechanism 200 or the second connecting mechanism 300 by sliding on the support 110.

Further, the switching mechanism 100 may include a first toggle assembly 101-1 and a second toggle assembly 101-2. The switching mechanism may include a set of first connecting mechanisms and a set of second connecting mechanisms drivingly connected with the first toggle assembly 101-1, and another set of first connecting mechanism and another set of second connecting mechanism drivingly connected with the second toggle assembly 101-2.

The support 110 may include one or more positioning shafts. The positioning shaft may be fixedly disposed on the support 110. The positioning shaft may include a rod structure. The rod structure may be in a shape of a cylinder, a rectangular cuboid, etc. In some embodiments, as shown in FIGS. 3A-3C, the positioning shaft may include a first positioning shaft 111 and a second positioning shaft 112. The first positioning shaft 111 may be spaced apart from the second positioning shaft 112 in an x-axis direction, and the first positioning shaft 111 and the second positioning shaft 112 may be spaced apart in a y-axis direction. As described herein, being disposed in the x-axis direction indicates that the first positioning shaft 111 and the second positioning shaft 112 are disposed perpendicular to an x-axis, and being disposed in the y-axis direction indicates that the first positioning shaft 111 and the second positioning shaft 112 are disposed perpendicular to a y-axis. In other words, the first positioning shaft 111 and the second positioning shaft 112 may be perpendicular to a plane formed by the x-axis and the y-axis. Spacing distances between the first positioning shaft 111 and the second positioning shaft 112 in the plane formed by the x-axis and the y-axis may be set as needed.

In some embodiments, the first positioning shaft 111 may include a pair of first positioning sub-shafts coaxially disposed in a z-axis direction, and the second positioning shaft 112 may include a pair of second positioning sub-shafts coaxially disposed in the z-axis direction. As described herein, being coaxially disposed in the z-axis direction indicates that the first positioning shaft 111 and the second positioning shaft 112 are disposed parallel to a z-axis.

In some embodiments, as shown in FIGS. 3A-3C, the support 110 may include a first crossbar 110-1 and a second crossbar 110-2 parallel to the x-axis, and the first crossbar 110-1 may be spaced apart from the second crossbar 110-2 in the z-axis direction. The two first positioning sub-shafts of the first positioning shaft 111 may be disposed on a lower surface of the first crossbar 110-1 and an upper surface of the second crossbar 110-2, respectively, and the two first positioning sub-shafts may be coaxial in the z-axis direction. The two second positioning sub-shafts of the second positioning shaft 112 may be disposed on side surfaces (e.g., sides facing the outside of the paper in FIG. 3*a*-FIG. 3*c*) of the first crossbar 110-1 and the second crossbar 110-2, respectively, and the two second positioning sub-shafts may be coaxial in the z-axis direction.

In some embodiments, the toggle member 120 may be slidably connected with the first positioning shaft 111 and the second positioning shaft 112. In some embodiments, the toggle member 120 may move in the x-axis direction and the y-axis direction simultaneously when the toggle member 120 slides along at least one of the first positioning shaft 111 and the second positioning shaft 112.

In some embodiments, the toggle member 120 may include a moving sleeve 121 and a connecting member. The toggle member 120 may move relative to at least one positioning shaft (the first positioning shaft 111 and the second positioning shaft 112) through the moving sleeve 121, and the toggle member 120 may be connected with the first connecting mechanism 200 or the second connecting mechanism 300 through the connecting member. In some embodiments, the toggle member 120 may only include the moving sleeve 121 and not include the connecting member. The moving sleeve 121 may have a connection function of the connecting member, i.e., the toggle member 120 may be connected with the first connecting mechanism 200 or the second connecting mechanism 300 through the moving sleeve 121 when the toggle member 120 moves relative to the at least one positioning shaft through the moving sleeve 121.

In some embodiments, the moving sleeve 121 may be provided with a Z-groove 122. The first positioning shaft 111 and the second positioning shaft 112 may be able to slide in the Z groove 122. The Z-groove 122 may have a guiding effect with respect to the first positioning shaft 111 and the second positioning shaft 112. For example, the first positioning shaft 111 and the second positioning shaft 112 may be respectively provided with protrusions that match the Z-groove 122 and are embedded in the Z-groove 122, so that when the moving sleeve 121 moves, the protrusions may move in the Z-groove 122 relative to the Z-groove 122.

In some embodiments, the Z-groove 122 may be in any other feasible shape as long as two ends of the groove are spaced apart in the y-axis direction. For example, the Z-groove 122 may be diagonal. As another example, the Z-groove 122 may include a flat straight line segment portion and a diagonal line segment portion that are parallel to the x-axis direction.

In some embodiments, the Z-groove 122 may include a first straight line segment, a diagonal segment, and a second straight line segment. The first straight line segment and the second straight line segment may be respectively parallel to the x-axis direction, and the first straight line segment and the second straight line segment may be spaced apart in the y-axis direction (i.e., positions of the first straight line segment and the second straight line segment may be in the y-axis direction). The diagonal segment connects the first straight line segment and the second straight line segment. When the toggle member 120 is moved in the x-direction, the Z-groove 122 may slide with respect to the at least one of the first positioning shaft 111 and the second positioning shaft 112. When sliding from the first straight line segment to the second linear segment of the Z-groove 122 (or when sliding from the second linear segment to the first linear segment), the toggle member 120 may move in the y-axis direction under the action of the at least one positioning shaft (e.g., the first positioning shaft 111 and the second positioning shaft 112) in a relatively fixed position cooperating with the Z-groove 122 simultaneously.

In some embodiments, as shown in FIG. 3A, when the toggle member 120 is moved until both the first positioning shaft 111 and the second positioning shaft 112 are located in the Z-groove 122, the connecting member may be drivingly connected with the first connecting mechanism 200, and the switching mechanism may be in the first state.

In some embodiments, as shown in FIG. 3B, when the toggle member 120 is moved until when only the second positioning shaft 112 is located in the Z-groove 122, the connecting member may be drivingly connected with the second connecting mechanism 300, and the switching mechanism may be in the second state.

In some embodiments, the connecting member being drivingly connected with the first connecting mechanism 200 or the second connecting mechanism 300 may be a connection in the y-axis direction, i.e., a power transmission may be achieved in the y-axis direction. For example, as shown in FIGS. 1A-1C, the connecting member and the first connecting mechanism 200 or the second connecting mechanism 300 may achieve a tooth meshing connection in the y-axis direction, thereby carrying out the power transmission. More descriptions regarding the connection member being drivingly connected with the first connecting mechanism 200 or the second connecting mechanism 300 may be found in the present disclosure elsewhere in the present disclosure. The power transmission in the y-axis direction may be realized by applying only a force in the x-axis direction to the toggle member 120 when the toggle member 120 is moved. Therefore, a direction (e.g., x-axis direction) in which the toggle member 120 is moved for state switching may be different from a direction (e.g., y-axis direction) of the transmission connection. The direction (e.g., x-axis direction) in which the toggle member 120 switches states is different from the direction (e.g., y-axis direction) in which the power transmission is connected, so that the two directions may not affect each other, and the connection may be more stable and the power transmission effect may be better.

In some embodiments, the switching mechanism 100 may include a plurality of toggle assemblies, and the toggle members of the plurality of toggle assemblies 101 may be moved synchronously. For example, the toggle member 120 of the first toggle assembly 101-1 and the toggle member 120 of the second toggle assembly 101-2, as shown in FIG. 1B, may be connected through a connecting rod 125 to ensure that the two toggle members 120 move synchronously to increase the stability of the entire device.

In some embodiments of the present disclosure, the toggle member may skillfully realize the simultaneous movement in both the x-axis and the y-axis directions, and the switching mechanism may switch between two states accordingly by converting the user's operation of the x-axis direction of the toggle member into the movement of the toggle member in the y-axis direction, and the transmission may be stable.

In some embodiments, the support 110 may include a guiding structure, such as a guiding groove. The toggle member 120 may be provided with a guiding member (e.g., an embedded protrusion) that matches the guiding structure, and the embedded protrusion of the toggle member 120 may be moved along the guiding groove.

In some embodiments, the switching mechanism may include a positioning structure. The positioning structure may include a positioning post. The positioning post may extend in a movement direction of the toggle member 120 when the positioning post moves to a set position (e.g., when the toggle member 120 is drivingly connected with the first connecting mechanism 200 or the second connecting mechanism 300) to block the movement of the toggle member 120, thereby limiting the toggle member 120, so that the toggle member 120 may be drivingly connected with the first connecting mechanism 200 or the second connecting mechanism 300 stably.

In some embodiments, the positioning post may be connected with a micro motor. The positioning post may be controlled to stretch out and draw back by the micro motor. In some embodiments, the toggle member 120 may include two separate portions. One portion of the toggle member 120 may be moved to be drivingly connected with the first connecting mechanism 200, and another portion of the toggle member 120 may be moved to be drivingly connected with the second connecting mechanism 300. The switching mechanism 100 may be drivingly connected with the first connecting mechanism 200 or the second connecting mechanism 300 by respectively controlling the two portions to move.

In some embodiments, the switching mechanism 100 may have any other feasible structure as long as the switching mechanism 100 may be drivingly connected with the first connecting mechanism 200 or the second connecting mechanism 300.

Figure 5:
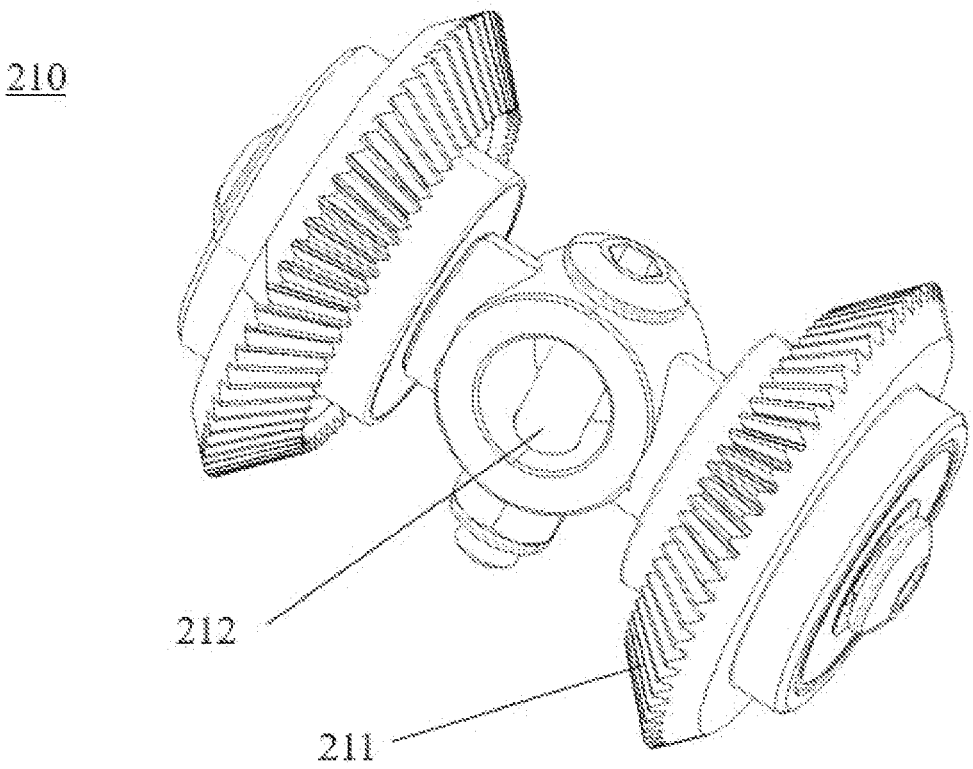
FIG. 5 is a structural diagram illustrating an exemplary central gear assembly of the first connection mechanism according to some embodiments of the present disclosure.

FIG. 4 is a diagram illustrating an exemplary partial structure of FIG. 1C according to some embodiments of the present disclosure. FIG. 5 is a structural diagram illustrating an exemplary central gear assembly of the first connection mechanism according to some embodiments of the present disclosure.

In some embodiments, as shown in FIGS. 1A-5, the first connecting mechanism 200 may include a central gear assembly 210 and a bevel gear 220. The central gear assembly 210 may include a fixed gear 211. The switching device may be in the first state by the toggle member 120 sliding towards a first position for driving, through the connecting member, the bevel gear 220 to mesh with the fixed gear 211.

In some embodiments, as shown in FIG. 5, the central gear assembly 210 may further include a central positioning pin 212. The fitness equipment may include a pull wheel assembly 460 and a transmission shaft 470. The central gear assembly 210 may be fixed to the transmission shaft 470 through the central positioning pin 212, and a rotating shaft of the fixed gear 211 may be perpendicular to an axis (y-axis direction) of the transmission shaft 470. The transmission shaft 470 may be configured to connect the resistance module 500 to provide resistance for the fitness equipment.

In some embodiments, as shown in FIG. 4, the bevel gear 220 may be disposed on a side of the toggle member 120 close to the pull wheel assembly 460, and the bevel gear 220 may be connected with the pull wheel assembly 460. When the toggle member 120 is moved in a negative direction of the y-axis, the connecting member of the toggle member 120 may drive the bevel gear 220 to move in the negative direction of the y-axis. In some embodiments, the connecting member of the toggle member 120 may be any feasible structure, or the toggle member 120 may not have the connecting member as long as the toggle member 120 may drive the bevel gear 220 to move in the negative direction of the y-axis.

In some embodiments, as shown in FIG. 3A and FIG. 4, the first position refers to that the toggle member 120 is located in a maximum position in the negative direction of the y-axis. At this time, the first positioning shaft 111 and the second positioning shaft 112 may be both located in the Z-groove 122, the bevel gear 220 may mesh with the fixed gear 211, and the switching device may be in the first state.

For example, as shown in FIG. 2, the fitness equipment may be a strength training station. The fitness equipment may include a pull rope 440 and an elastic rope 350, and a user may train by pulling the pull rope 440. When the user pulls the pull rope 440 and the elastic rope 450, the pull wheel assembly 460 may be driven to rotate, the pull wheel assembly 460 may rotate to drive the central gear assembly 210 to rotate, and the resistance module 500 may provide resistance (i.e., a force in an opposite direction of a force exerted by the user) for the central gear assembly 210 through the transmission shaft 470. When the user releases the force exerted on the pull rope 440, at this time, the resistance module 500 may also provide resistance to the transmission shaft 470 and the pull wheel assembly 460, and the pulled pull rope 440 may be rewound around the pull wheel assembly 460, and the elastic rope 450 may follow the pull wheel assembly 460 back into position at the same time. The bevel gear 220 meshes with the central gear assembly 210, so that torque may be transmitted in both forward and reverse directions, the pulling out and recovery of the pull rope may be subject to the resistance provided by the resistance module 500, and the fitness equipment may be in a high-resistance and high-intensity strength training mode (i.e., a first mode).

In some embodiments, as shown in FIG. 4, the second connecting mechanism 300 may include a unidirectional wheelset 310, and the unidirectional wheelset 310 may include a unidirectional gear 311. In some embodiments, the switching device may be in the second state by the toggle member 120 sliding toward a second position for driving, through the connecting member to mesh with the unidirectional gear 311. The pull wheel assembly 460 may be connected with the unidirectional wheelset 310. In some embodiments, the unidirectional gear 311 may unidirectionally mesh with the transmission shaft 470. When the transmission shaft 470 rotates positively, the unidirectional wheelset 310 may rotate with the transmission shaft 470.

When the transmission shaft 470 rotates in reverse, the unidirectional gear 311 may no longer mesh with the unidirectional gear 311, and the unidirectional gear 311 may rotate freely without transmitting torque. In some embodiments, the unidirectional wheelset 310 may be a gear set with unidirectional teeth on an end face.

In some embodiments, as shown in FIG. 3B and FIG. 4, the second position refers to that the toggle member 120 is located at a maximum position in a positive direction of the y-axis. At this time, only the second positioning shaft 112 may be located in the Z-groove 122, and the unidirectional gear 311 may mesh with the connecting member. In some embodiments, the connecting member may include inner teeth 123. When the toggle member 120 moves in the positive direction of the y-axis, the inner teeth 123 may be driven to move in the positive direction of the y-axis until the inner teeth 123 meshes with the unidirectional gear 311. At this time, the central gear assembly 210 and the bevel gear 220 may be in a state of separation. When the user pulls the pull rope 440 and the elastic rope 450, the pull wheel assembly 460 may be driven to rotate, the pull wheel assembly 460 may rotate to drive the unidirectional wheelset 310 to rotate, the unidirectional wheelset 310 may transmit the torque, and the user may be subjected to the resistance provided by the resistance module 500 when pulling out the pull rope 440. When the user releases the force exerted on the pull rope 440, at this time, a rebound force of the elastic rope 350 may drive the pull wheel assembly 460 to reverse, and the pull rope 440 pulled out may be rewound around the pull wheel assembly 460. Because the unidirectional wheel assembly 310 reverses without transmitting the torque, the resistance module 500 may not provide the resistance. In this case, the pull rope 440 may bear the resistance when pulled out and bear no resistance when recovered, and the fitness equipment 600 may be in a low-resistance and low-intensity aerobic training mode (i.e., a second mode).

In some embodiments of the present disclosure, two connection modes of connecting the pull wheel assembly to the central gear assembly and connecting the pull wheel assembly to the unidirectional wheelset may be switched, respectively, through the toggle assembly, so that the fitness equipment may be switched between the strength training mode and the aerobic training mode through the switching device, and the user may easily access the training modes through the single equipment.

FIG. 6 is a structural diagram illustrating an exemplary fitness equipment according to some embodiments of the present disclosure.

In some embodiments, if a switching device is in a first state, the fitness equipment 600 may be in a first mode. if the switching device is in a second state, the fitness equipment 600 may be in a second mode. Exemplarily, as shown in FIG. 6, the fitness equipment 600 may be a strength training station, and the first mode may correspond to a strength training mode and the second mode may correspond to an aerobic training mode. More descriptions regarding the states of the switching device and the modes of the fitness equipment 600 may be found in the present disclosure above, which is not repeated herein.

In some embodiments, as shown in FIG. 6, the fitness equipment 600 may further include a resistance module 500 and a pull wheel assembly (e.g., the pull wheel assembly 460 as shown in FIG. 4). When the switching device is in the first state, the resistance module 500 may be drivingly connected with the pull wheel assembly 460 through the first connecting mechanism 200. When the switching device is in a second state, the resistance module 500 may be drivingly connected with the pull wheel assembly 460 through the second connecting mechanism 300. In some embodiments, the resistance module 500 may include an output shaft, and the output shaft of the resistance module 500 may be connected with the transmission shaft 470 (see FIG. 4) to transmit resistance to the fitness equipment 600. More descriptions regarding the resistance module 500 being drivingly connected with the pull wheel assembly 460 may be found in the present disclosure above, which is not repeated herein.

In some embodiments, referring to FIG. 2, the fitness equipment 600 may further include a first housing 420, a second housing 430, the pull rope 440, and the elastic rope 450. The first housing 420 and the second housing 430 may be configured to mount a component of the fitness equipment 600. The support 110 of the toggle assembly 101 may be mounted in the first housing 420 through a mounting member 410. The toggle assembly 101 may be connected with an operating member. The operating member may be removably disposed outside the first housing 420 for ease of operation of a user. More descriptions regarding the pull rope 440 and the elastic rope 450 may be found in the present disclosure above, which is not repeated herein.

In some embodiments, a fitness device may further include a physiological monitoring device, a motion monitoring device, and a controller. The controller may be configured to control mode switching of the training modes of the fitness equipment by controlling state switching of the switching device.

The physiological monitoring device refers to a device configured to monitor physiological monitoring data (e.g., heart rate, blood pressure, blood oxygen) of the user. The physiological monitoring device may be disposed at a position where the user is in contact with the fitness equipment 600. The motion monitoring device refers to a device configured to obtain motion data (e.g., a tensile force, a speed, or a count of times) of the user. For example, the motion monitoring device may include a displacement sensor, a speed sensor, and a tension sensor mounted on the pull rope or the elastic rope for monitoring the motion and tensile force of the pull rope. The sensors may determine a complete rope-pulling action by measuring changes of the speed, displacement, or tensile force of the rope-pulling motion, thereby counting the count of times the rope is pulled.

In some embodiments, the switching device may further include a drive motor. The drive motor may be connected with the switching mechanism 100, for example, the drive motor may be connected with the toggle member 120, so as to control the state switching of the switching device.

Some embodiments of the present disclosure further provide a method for switching a training mode, which may be applied to the above fitness device. The switching method may include extracting a motion feature of the user based on the motion data obtained by the motion monitoring device; determining a motion state of the user based on the physiological monitoring data obtained by the physiological monitoring device and the motion feature; and determining whether to switch the training mode of the fitness equipment 600 of the fitness device based on the motion state.

In some embodiments, the motion data may include a sequence of tensile force/speed during training. The motion feature may include a sequence including a frequency of a target behavior per unit of time, the time consumption of the target behavior, and the stability degree of the target behavior. The target behavior refers to a preset target exercise behavior, and the target behavior may be related to a type of fitness equipment 600. For example, if for the fitness equipment 600, training of different postures or actions may be completed by pulling the rope, the target behavior may be pulling the rope without distinguishing the specific action of pulling the rope. The controller may extract a count of cycles of the tensile force/speed change per unit time based on the tensile force/speed sequence during the training, and determine the count of cycles as the frequency of the target behavior per unit of time. For example, the frequency of the target behavior per unit time may be a count of times the rope is pulled in 1 minute. The time consumption of the target behavior refers to the time it takes the user to complete the last complete target behavior. The consumption time of the target behavior may be obtained by querying history. The stability degree of the target behavior may be used to characterize the stability degree of the strength or speed of the user during training. The stability degree of the target behavior may be obtained through statistical analysis. For example, the stability degree of the tensile force of the target behavior refers to a standard deviation of a plurality of tensile force values when the target behavior is completed.

In some embodiments, the motion state of the user may be expressed as a motion degree. In some embodiments, the more tired the user is, the smaller the value of the motion degree may be. In some embodiments, the controller may determine the motion degree. The controller may calculate a first similarity degree by comparing the physiological monitoring data with reference physiological data, and calculate a second similarity degree by comparing the motion feature with a reference motion feature. The current motion degree of the user is equal to (a×first similarity degree+b×second similarity degree), where a and b are preset weights.

In some embodiments, the reference physiological data may be obtained by obtaining the physiological monitoring data of the user during a time period T1~T2 in which a plurality of consecutive target behaviors are completed and taking an average value of each indicator of the physiological monitoring data of the user between T1 and T2 as a value of each indicator of the reference physiological data. In some embodiments, the reference motion feature may be obtained by: obtaining the motion data of the user during the time period T1~T2 in which the plurality of consecutive target behaviors are completed, extracting the motion feature, and taking an average value of each indicator of the motion feature of the user between T1 and T2 as a value of each indicator of the reference motion feature. For example, if the motion feature is the time consumption of the target behavior, and after a preset time from the start of the training, a time consumed to complete the plurality of consecutive target behaviors may be obtained and an average value of time consumption of each target behavior may be calculated, and the average value of time consumption may be used as the reference motion feature.

In some embodiments, the controller may determine whether to switch the training mode of the fitness equipment 600 based on the motion degree. For example, in the strength training mode, when the motion degree of the user is smaller than a first threshold, the strength training mode may be switched to the aerobic training mode. In the aerobic training mode, when the motion degree of the user is greater than a second threshold, the aerobic training mode may be switched to the strength training mode. The first threshold may be smaller than the second threshold. When the value of the current motion degree of the user in the strength training mode is lower, it may indicate that the user may be in a state of fatigue, and at this time, the resistance may need to be reduced and appropriate relaxation may need to be carried out. Therefore, the strength training mode may be switched to the aerobic training mode. At the same time, when the current motion degree of the user is relatively easy for the user in the aerobic training mode, the motion degree may be appropriately enhanced, and the aerobic training mode may be switched to the strength training mode. The first threshold and the second threshold may be values manually set based on experience.

In some embodiments, the user may set a switching time between the two modes voluntarily. The switching time may be directly determined based on a training goal input by the user according to a preset relationship. The training goal input by the user may be set in advance in the system and selected by the user, such as muscle gain or weight loss; or the training goal may be a specific goal value input by the user, such as a motion duration or a muscle gain weight. The preset relationship may be a correspondence between the training goal and the motion mode and motion time set in advance in the system. In some embodiments, the user may preset a switching frequency of the strength training mode and the aerobic training mode. In some embodiments, the user may input via software communicatively connected with the fitness equipment 600. In some embodiments, the user may achieve mode switching via a button, an interactive screen, or a voice acquisition system of the fitness equipment 600.

In some embodiments, the controller may adjust the resistance module of the fitness equipment 600 in response to the motion state not meeting a preset condition. The adjusting the resistance of the resistance module may be to increase the resistance or to decrease the resistance. In some embodiments, the adjustment of the resistance of the resistance module may be related to mode switching. For example, the resistance may be increased in the aerobic training mode, and the resistance may be further increased in the strength training mode when the aerobic training mode is switched to the strength training mode.

In some embodiments, in the strength training mode, after the strength training mode is conducted for a preset time period, and if the preset condition is that the first threshold<the motion degree of the user<a third threshold, and the controller controls the resistance module to decrease the resistance, it may indicates that the mode switching condition has not been reached, but the user is still relatively tired, and the resistance may need to be decreased; or if the preset condition is that the motion degree of the user>the third threshold, and the controller controls the resistance module to increase the resistance, it may indicate that the mode switching condition has not been reached, and the user is in a relatively relaxed state, and thus the resistance may need to be increased.

In some embodiments, in the aerobic training mode, after the aerobic training mode is conducted for the preset time period, and if the preset condition is that a fourth threshold<an ease degree of motion of the user<the second threshold, and the controller controls the resistance module to increase the resistance, it may indicates that the mode switching condition has not been reached and the user is in a relatively easy state, and thus the resistance may need to be increased; or if the preset condition is that 0<the ease degree of motion of the user<the fourth threshold, and the controller controls the resistance module to decrease the resistance, it may indicate that the user is a little bit tired, and thus the resistance may need to be decreased. A relationship may be that the first threshold<the second threshold<the third threshold<the fourth threshold. The third threshold and the fourth threshold may be values manually set based on experience. The adjustment of the resistance of the resistance module may be obtained by a preset correspondence between the motion degree of the user and an amount of resistance adjustment. The correspondence may be set manually based on experience.

In some embodiments of the present disclosure, the mode may be switched and the resistance of the resistance module may be changed through the training intensity of the user, which may make the current motion intensity of the fitness equipment 600 suitable for the current state of the user to satisfy an exercise need of a customer and prevent the user from being in an excessive fatigue state, thereby reducing the risk of injury to the user and improving the exercise experience of the user.

Figure 7:
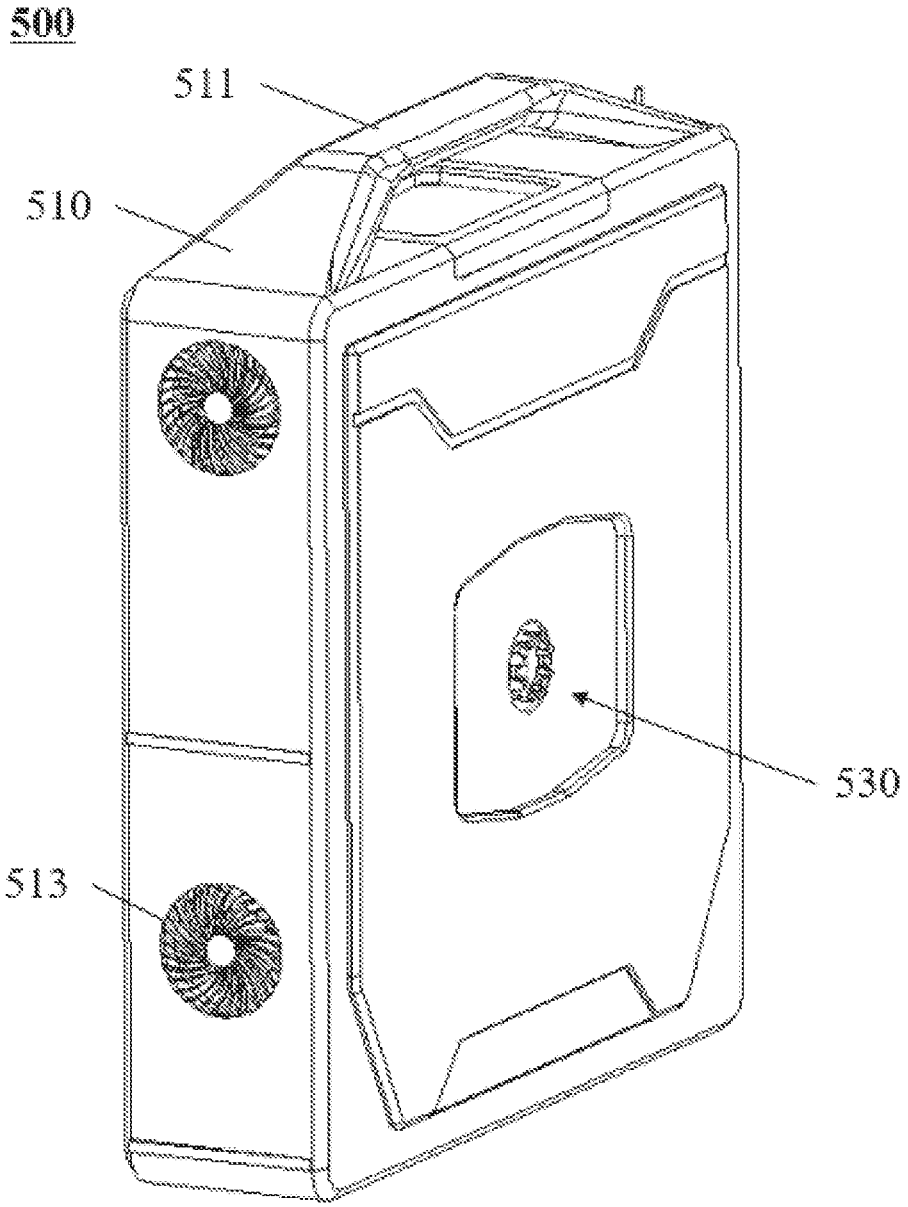
FIG. 7 is a structural diagram illustrating an exemplary resistance module according to some embodiments of the present disclosure.
Figure 8:
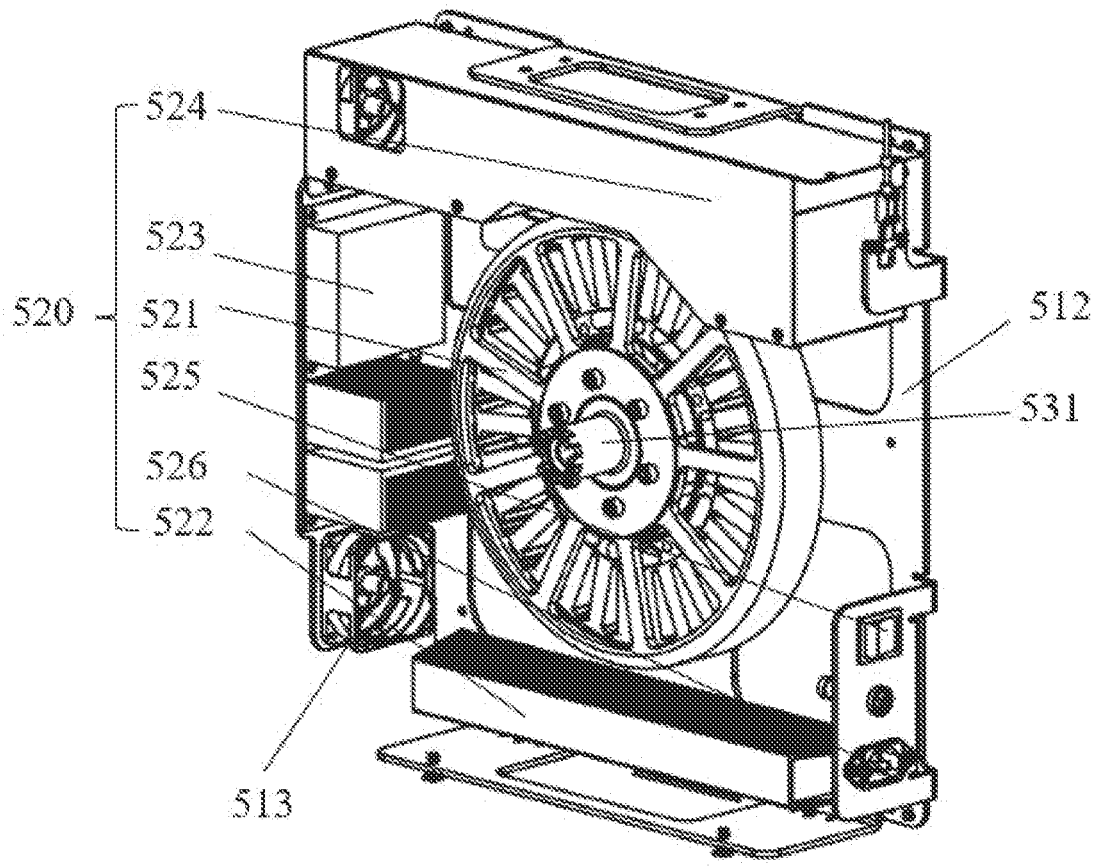
FIG. 8 is a diagram illustrating an exemplary internal structure of a resistance module according to some embodiments of the present disclosure.
Figure 9:
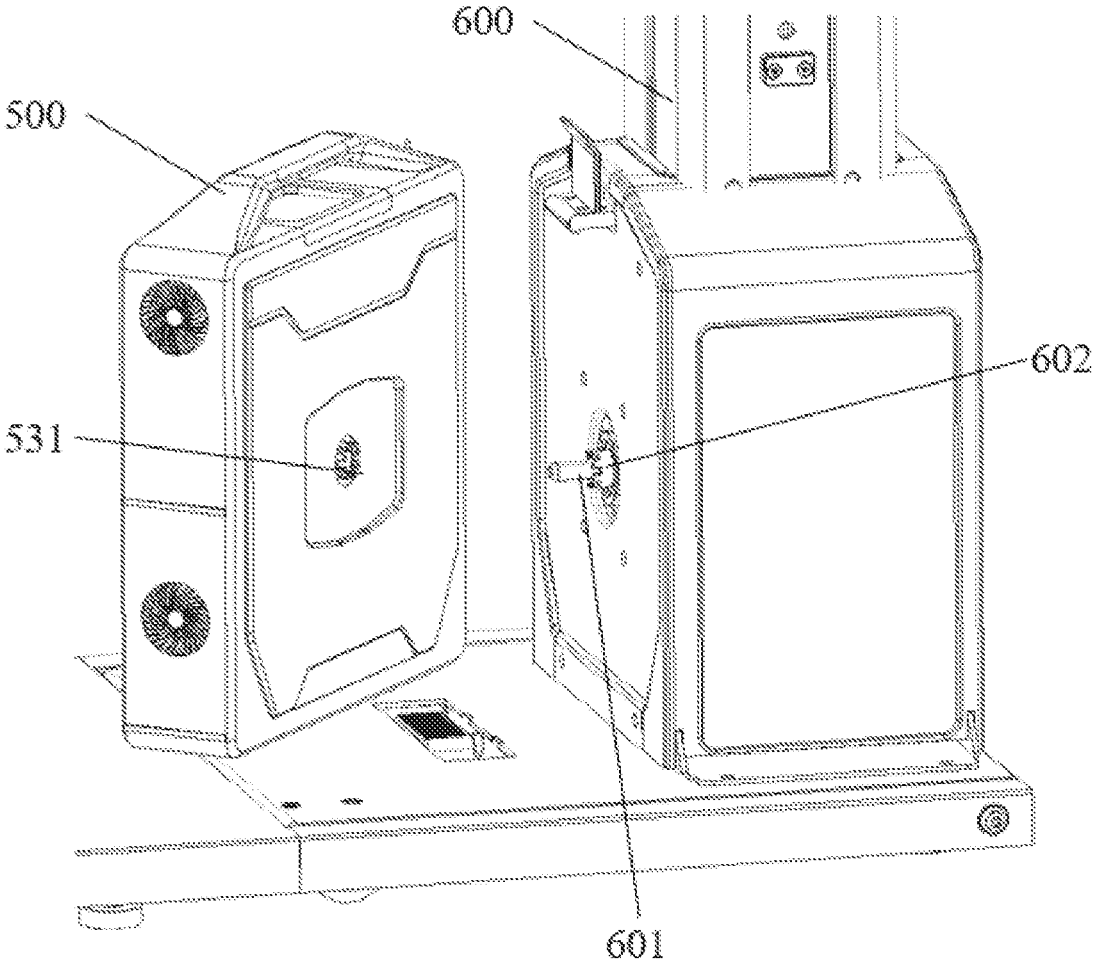
FIG. 9 is a diagram illustrating an exemplary partial structure of a resistance module and a fitness equipment according to some embodiments of the present disclosure.

FIG. 7 is a structural diagram illustrating an exemplary resistance module according to some embodiments of the present disclosure. FIG. 8 is a diagram illustrating an exemplary internal structure of a resistance module according to some embodiments of the present disclosure. FIG. 9 is a diagram illustrating an exemplary partial structure of a resistance module and a fitness equipment according to some embodiments of the present disclosure.

In some embodiments, as shown in FIGS. 7-9, the resistance module 500 may include a housing 510, a power device 520, and a transmission mechanism 530. In some embodiments, the transmission mechanism 530 may include a connecting shaft 531. The connecting shaft 531 may be configured to be drivingly connected with different fitness equipment. The power device 520 may provide resistance to the fitness equipment through the connecting shaft 531. In some embodiments, the fitness equipment may include a strength training station, a rowing machine, a ski machine, etc.

The housing 510 refers to a housing of the resistance module 500, and the housing 510 may provide support for other components of the resistance module 500 and protect an internal component of the resistance module 500. The material of the housing 510 may be metal, plastic, or other material that is strong enough to support the internal component of the resistance module 500.

In some embodiments, a handle 511 may be disposed of outside the housing 510, and a fixed plate 512 may be disposed of inside the housing 510. The handle 511 may be configured to facilitate a user to lift the resistance module 500 to mount the resistance module 500 on the different fitness equipment. The fixed plate 512 may be configured to mount the one or more internal components of the resistance module 600. In some embodiments, the power device 520 and the transmission mechanism 530 may be mounted on the fixed plate 512. A cooling fan 513 may be disposed on the fixed plate 512. The cooling fan 513 may be configured to dissipate heat from the resistance module 500.

The power device 520 refers to a device that may provide mechanical or electrical energy for the resistance module 500. In some embodiments, the power device 520 may include a motor assembly 521, a resistor 522, and a controller 523. The motor assembly 521 may be configured to provide resistance to the fitness equipment 600.

In some embodiments, the motor assembly 521 may include a motor stator, a magnet, a motor rotor, an encoder, etc. The resistor 522 may be configured to regulate an output of the motor assembly 521, and a magnitude of the output may correspond to a magnitude of the resistance provided by the resistance module 500 for the fitness equipment 600. In some embodiments, the resistor 522 may include a metal resistor, a cement resistor, or the like, or any combination thereof. The controller 523 may control a parameter (e.g., the output or a speed) of the motor assembly 521 to control the resistance provided for the fitness equipment 600. The controller 523 may be configured to process data from at least one component of resistance module 500 or an external data source. In some embodiments, the controller 523 may include a central processing unit (CPU), an application specific integrated circuit (ASIC), or the like, or any combination thereof.

In some embodiments, the power device 520 may further include a power source. A type of power source may include a plug-in power source or a battery. The battery may include a rechargeable battery 524. The plug-in power source may include a power switch 525 and a power port 526. The power port 526 may be connected with an external power source via a power cord. The power switch 525 may be configured to turn on and turn off the motor assembly 521.

The transmission mechanism 530 refers to a mechanism that transfers power of the power device 520 to the fitness equipment 600. In some embodiments, the transmission mechanism 530 may include a positioning shaft 601. In some embodiments, the connecting shaft 531 may be concentric with a rotating shaft of a gantry of the fitness equipment 600 through the positioning shaft 601. An end of the positioning shaft 601 may be provided with shaft teeth, and an end of the connecting shaft 531 may be provided with shaft teeth that match the shaft teeth of the positioning shaft 601, so that the positioning shaft 601 may mesh with the connecting shaft 531 via teeth.

In some embodiments, as shown in FIG. 9, the connecting shaft 531 may include a shaft sleeve for inserting the positioning shaft 601. The end of the connecting shaft 531 may be provided with the shaft teeth, and an outer side of the positioning shaft 601 may be provided with a shaft teeth sleeve 602 that matches the connecting shaft 531, so that the positioning shaft 601 may mesh with the connecting shaft 531 via the shaft tooth sleeve 602 meshing with the shaft teeth of the connecting shaft 531 after the positioning shaft 601 is inserted into the connecting shaft 531. In some embodiments, the positioning shaft 601 may be a component fixedly disposed on the gantry of the fitness equipment 600.

In some embodiments of the present disclosure, the transmission mechanism may be disposed so that the resistance module may be activated after being connected with the fitness equipment through the connecting shaft. The rotating shaft of the gantry of the fitness equipment may move synchronously with the connecting shaft, so as to provide resistance for fitness training of the user.

For the resistance module provided by some embodiments of the present disclosure, a function such as power provision and resistance adjustment may be integrated into a resistance module. The resistance module may be connected with the different fitness equipment through the connecting shaft and the connecting shaft may be further concentric with the rotating shaft of the gantry of the fitness equipment through the positioning shaft, so as to better provide resistance for the different fitness equipment. For example, the resistance module may be connected with different gantries such as a rowing machine, a ski machine, and an integrated strength training station, etc., which may provide power to the user by replacing a traditional system such as a traditional wind damping, water damping, magnetic damping, or weight counterweight. The user may adjust the training intensity and resistance as needed, thereby making training more flexible and personalized. The resistance module may be connected with various different fitness equipment, which may also save the user costs. The various fitness equipment may be obtained when only one resistance module is connected with the gantries of the various fitness equipment, which can greatly reduce the user costs.

At the same time, the handle of the resistance module is convenient to lift and push, and the power source of the resistance module may be the rechargeable battery, which is convenient to replace with different equipment. The cooling fan, the resistor, and the controller of the resistance module may provide good support for the performance of the resistance module. The shaft tooth meshing and positioning shaft positioning of the resistance module ensure a good transmission connection between the resistance module and the fitness equipment, so that the resistance module may be applied to the various different fitness equipment.

In some embodiments, the resistance module 500 may further include a taper structure. The taper structure may be disposed outside the connecting shaft 531. In some embodiments, the taper structure may match with a mating structure disposed on the fitness equipment 600 to make the connecting shaft 531 concentric with the rotating shaft of the gantry of the fitness equipment 600. The taper structure may be configured to further assist in aligning the connecting shaft 531 with the rotating shaft. In the process of alignment of the resistance module 500 with the fitness equipment 600, the taper structure and the mating structure may cooperate to guide the connecting shaft 531 of the resistance module 500 and the rotating shaft of the fitness equipment 600 to be concentric, which may improve the ease of alignment.

In some embodiments, an easy-to-observe place (e.g., top or side) of the taper structure may be provided with a through groove. The user may observe the meshing situation through the through groove. The material of the taper structure may be transparent plastic for easy observation of the user. In some embodiments, the taper structure may be also provided with a scale for indicating a meshing distance of the taper structure to indicate whether a meshing depth is satisfied. The meshing distance refers to a relative distance between two portions of the taper structure meshing with each other. If the scale reaches a preset position, it may be considered that the meshing depth is satisfied. The scale may be disposed at a position of the through groove, so that the user may observe the meshing and observe the meshing distance at the same time, thereby further improving the ease of observation of the user.

Figure 10A:
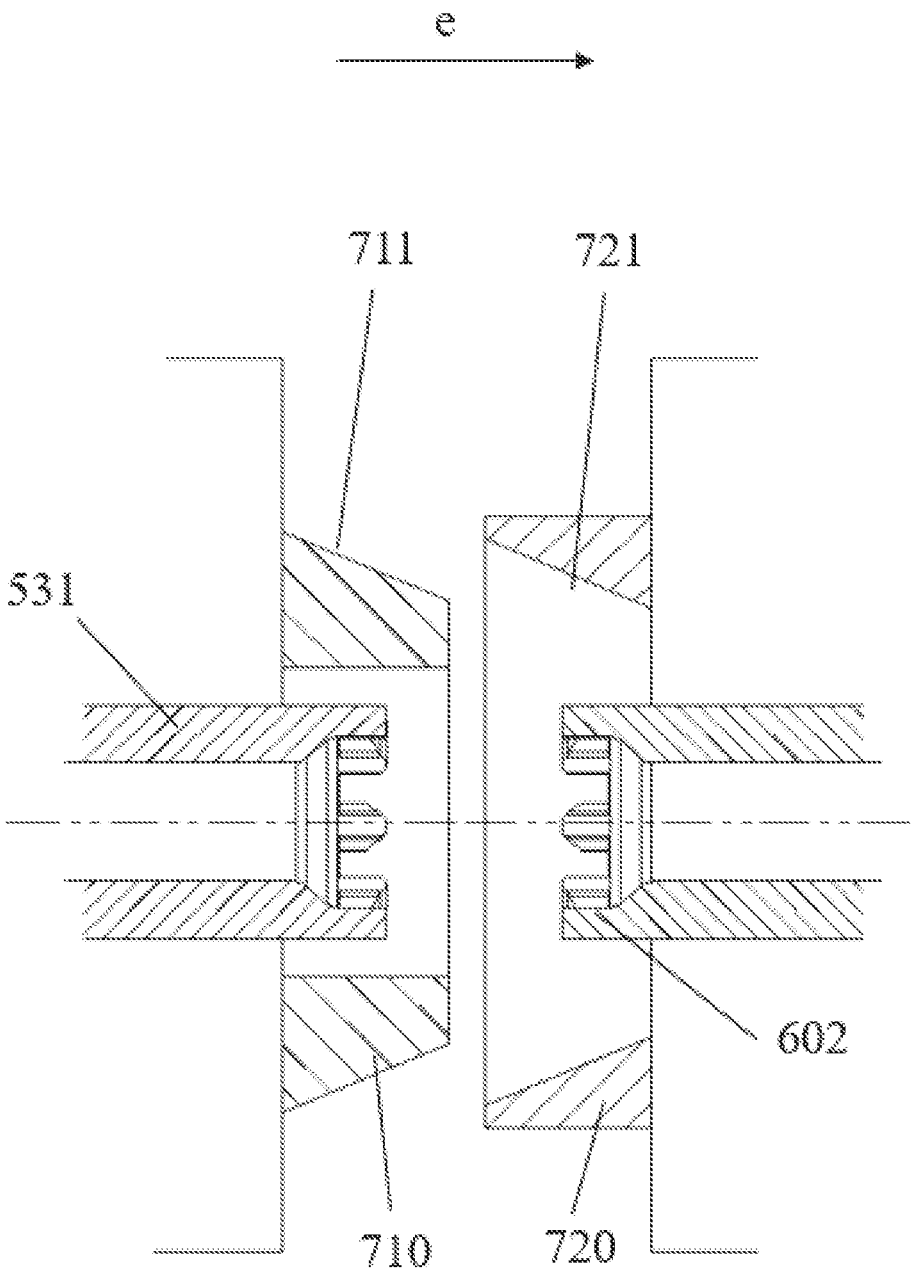
FIG. 10A is a structural diagram illustrating an exemplary taper structure according to some embodiments of the present disclosure.
Figure 10B:
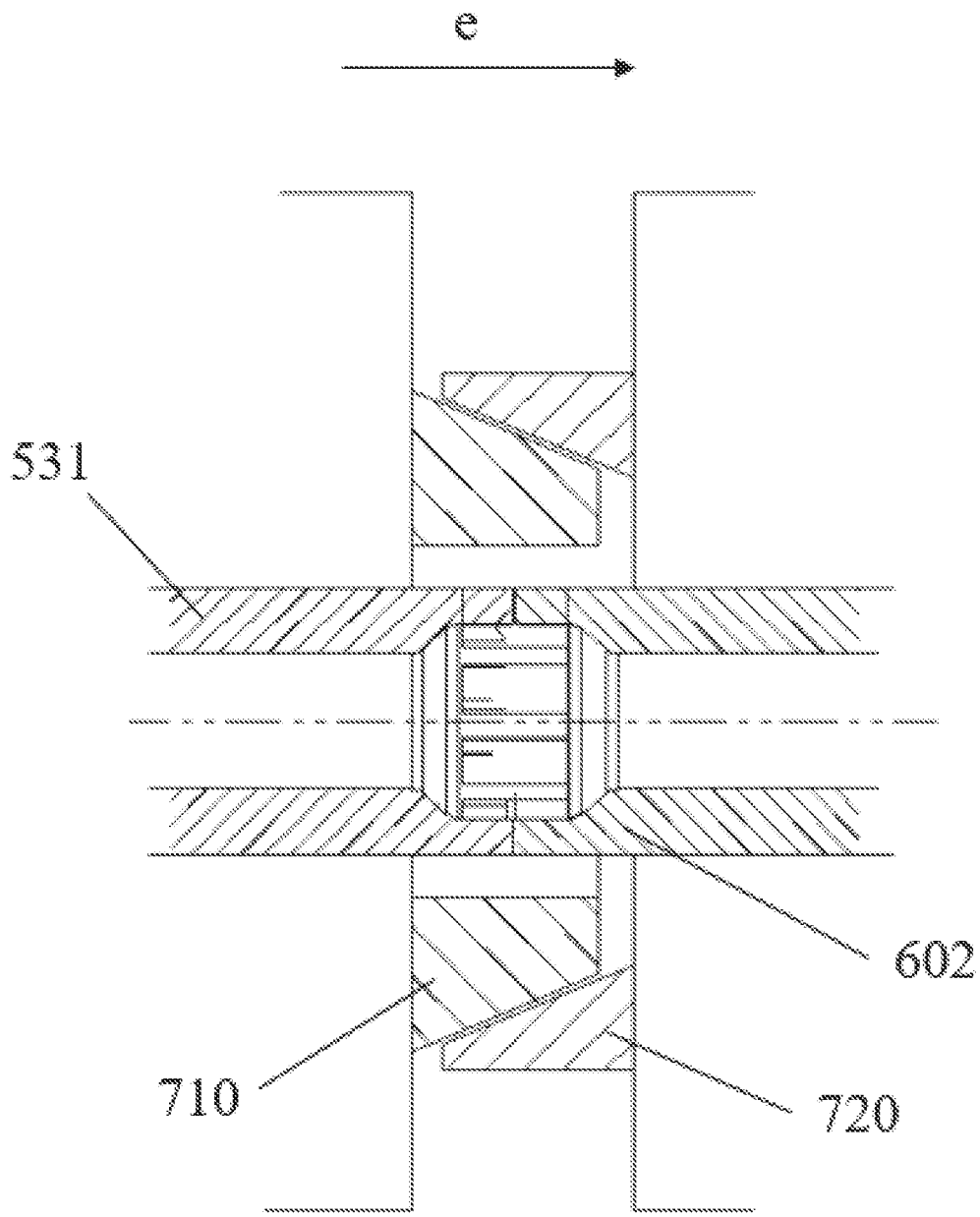
FIG. 10B is a structural diagram illustrating an exemplary meshing of a taper structure according to some embodiments of the present disclosure.

The taper structure is further described below in conjunction with the accompanying drawings. FIG. 10A is a structural diagram illustrating an exemplary taper structure according to some embodiments of the present disclosure. FIG. 10B is a structural diagram illustrating an exemplary meshing of a taper structure according to some embodiments of the present disclosure.

As shown in FIG. 10A and FIG. 10B, the taper structure may include an outer taper member 710 and an inner taper member 720. The outer taper member 710 may be disposed around an outer side of the connecting shaft 531, and the inner taper member 720 may be disposed around an outer side of the shaft tooth sleeve 602. An outer side 711 of the outer taper member 710 may be an inclined side relative to a surface where the outer taper member 710 is mounted, and an inner side 721 of the inner taper member 720 may be an inclined side relative to a surface where the inner taper member 720 is mounted. An inclined angle of the outer side 711 of the outer taper member 710 may match with an inclined angle of the inner side 721 of the inner taper member 720, i.e., along the direction e in FIG. 10*a* and FIG. 10*b*, a diameter of the outer side 711 of the outer taper member 710 may gradually decrease and a diameter of the inner side 721 of the inner taper member 720 may gradually increase, so that the outer side 711 of the outer taper member 710 and the inner side 721 of the inner taper member 720 may be fitted to each other. When the resistance module 500 is close to the fitness equipment 600, the outer taper member 710 may be relatively far away from the inner taper member 720 (as shown in FIG. 10*a*), so it may be easy to operate. In the process of the resistance module 500 approaching the fitness equipment 600, the connecting shaft 531 of the resistance module 500 and the shaft tooth sleeve 602 of the fitness equipment 600 may gradually move towards a center of the connecting shaft due to the guidance of the taper structure, so that concentricity may be easily achieved. When the shaft teeth of the resistance module 500 mesh with the shaft tooth sleeve 602, the outer taper member 710 and the inner taper member 720 may also be fitted (as shown in FIG. 10*b*), so that the meshing positioning and concentricity may be completed.

In some embodiments, the length of the outer taper member 710 and the length of the inner taper member 720 may be greater than the positioning length of the positioning shaft 601. The positioning length refers to an extension length of a portion of the positioning shaft 601 that extends outside of the shaft tooth sleeve 602. The taper structure may assist in the positioning of the positioning shaft 601 before the positioning of the positioning shaft 601, which may improve the convenience of penetration of the positioning shaft 601.

Figure 11:
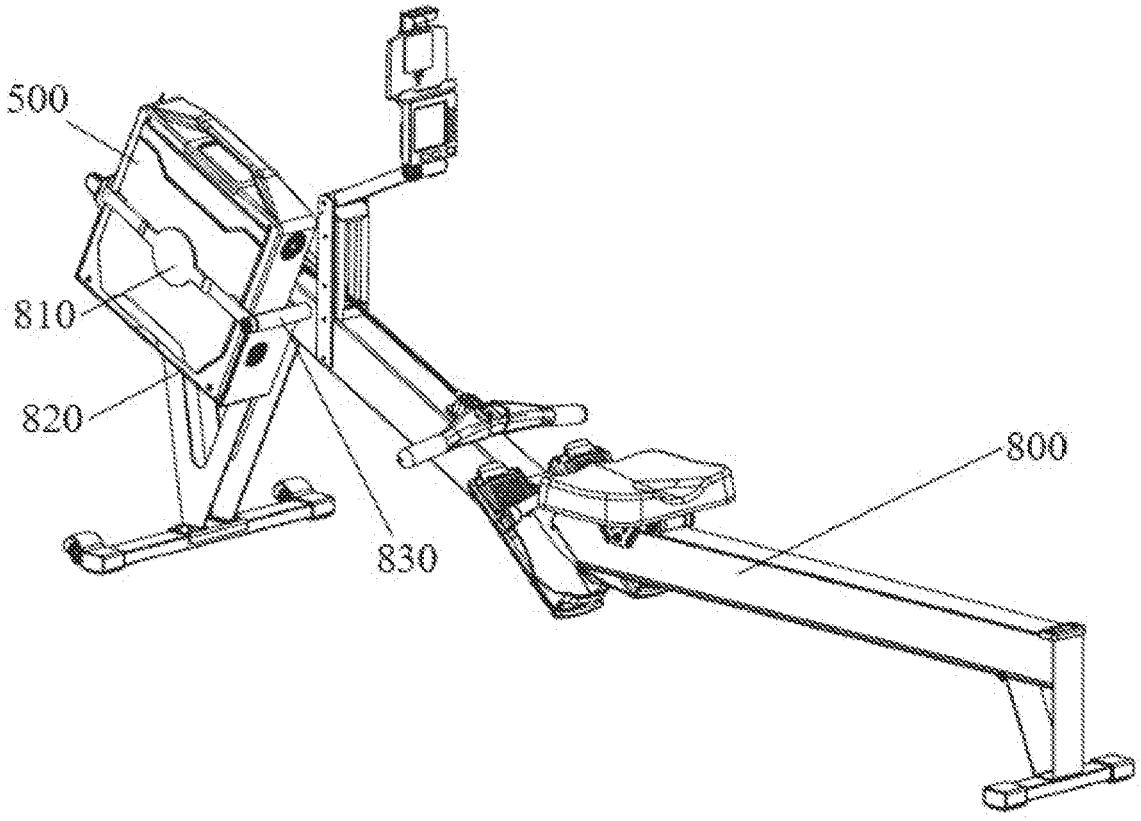
FIG. 11 is a structural diagram illustrating an exemplary resistance module and a fitness equipment according to some embodiments of the present disclosure.
Figure 12:
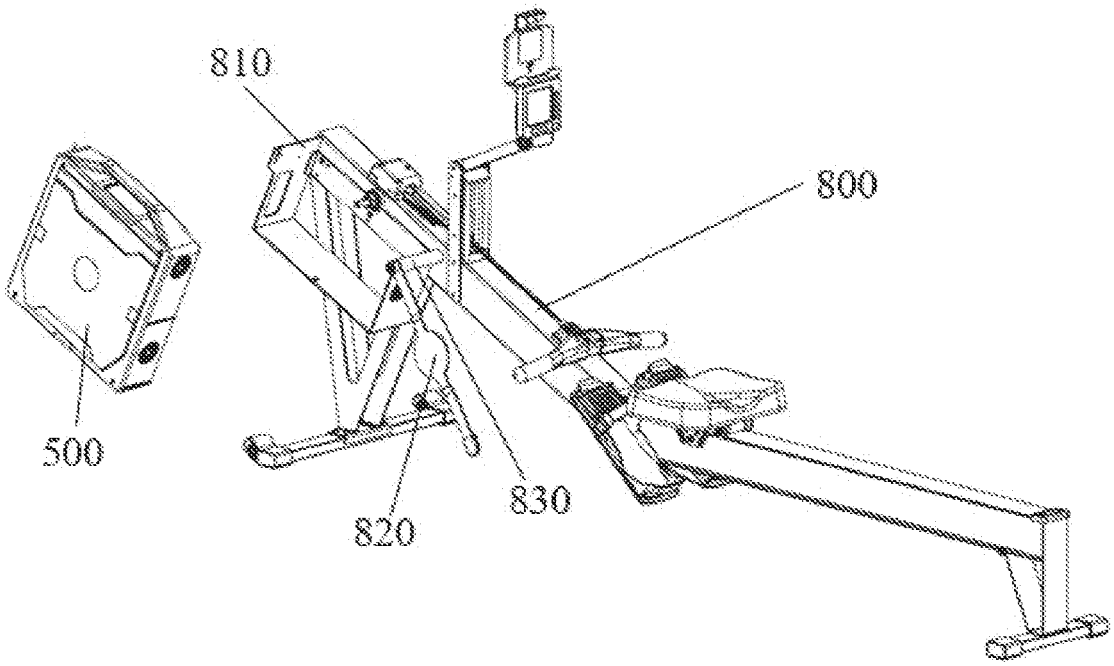
FIG. 12 is a structural diagram illustrating an exemplary mounting structure according to some embodiments of the present disclosure.

FIG. 11 is a structural diagram illustrating an exemplary resistance module and a fitness equipment according to some embodiments of the present disclosure. FIG. 12 is a structural diagram illustrating an exemplary mounting structure according to some embodiments of the present disclosure.

In some embodiments, the fitness equipment may include the mounting structure configured to mount the resistance module 500. The mounting structure may be disposed on the fitness equipment, and the resistance module 500 may be fixed relative to the fitness equipment through the mounting structure. Understandably, the mounting structure may be determined according to a structural feature of the fitness equipment.

In some embodiments, as shown in FIG. 11 and FIG. 12, the fitness equipment may be a rowing machine 800, the mounting structure may be disposed on the rowing machine 800, and the mounting structure may include a fixed frame 810, a fixed plate 820, and a hinge 830. The fixed frame 810 may be provided with a three-sided support plate matching the resistance module 500, and the fixed frame 810 may be configured to support the resistance module 500 from at least three directions. The fixed plate 820 may be configured to limit the position of the resistance module 500, and the fixed plate 820 may be rotated along the hinge 830. In some embodiments, a process of fixing the resistance module 500 is as follows. The resistance module 500 may be placed into the fixed frame 810, the fixed plate 820 may be rotated along the hinge 830 until the fixed plate 820 is rotated to a position where the fixed plate 820 fits the resistance module 500, the fixed plate 820 may be connected with the fixed frame 810, and the mounting may be completed. The connection manner may include a snap fit connection, a pin connection, a threaded connection, etc.

Figure 13:
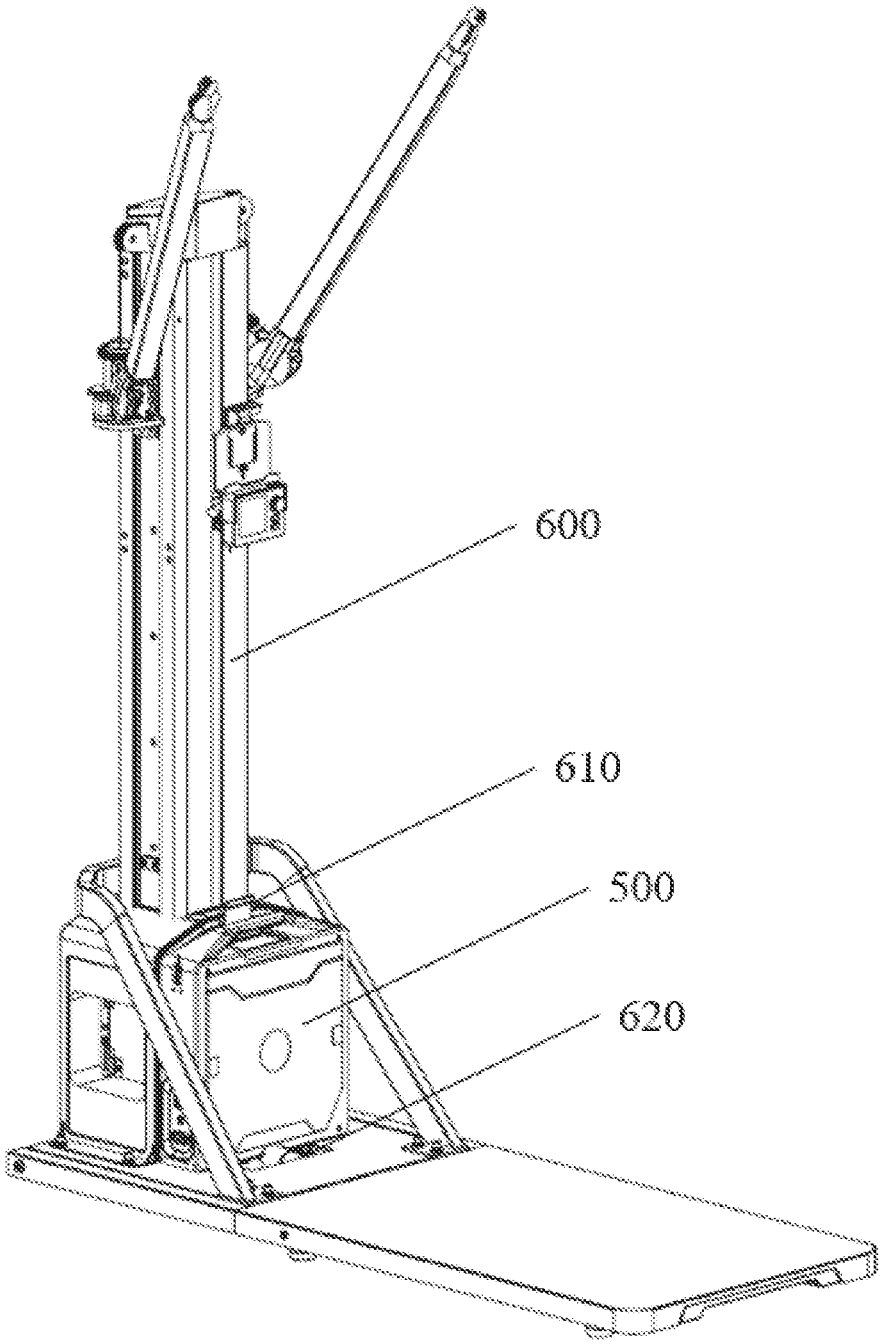
FIG. 13 is a structural diagram illustrating an exemplary resistance module and another fitness equipment according to some embodiments of the present disclosure.
Figure 14:
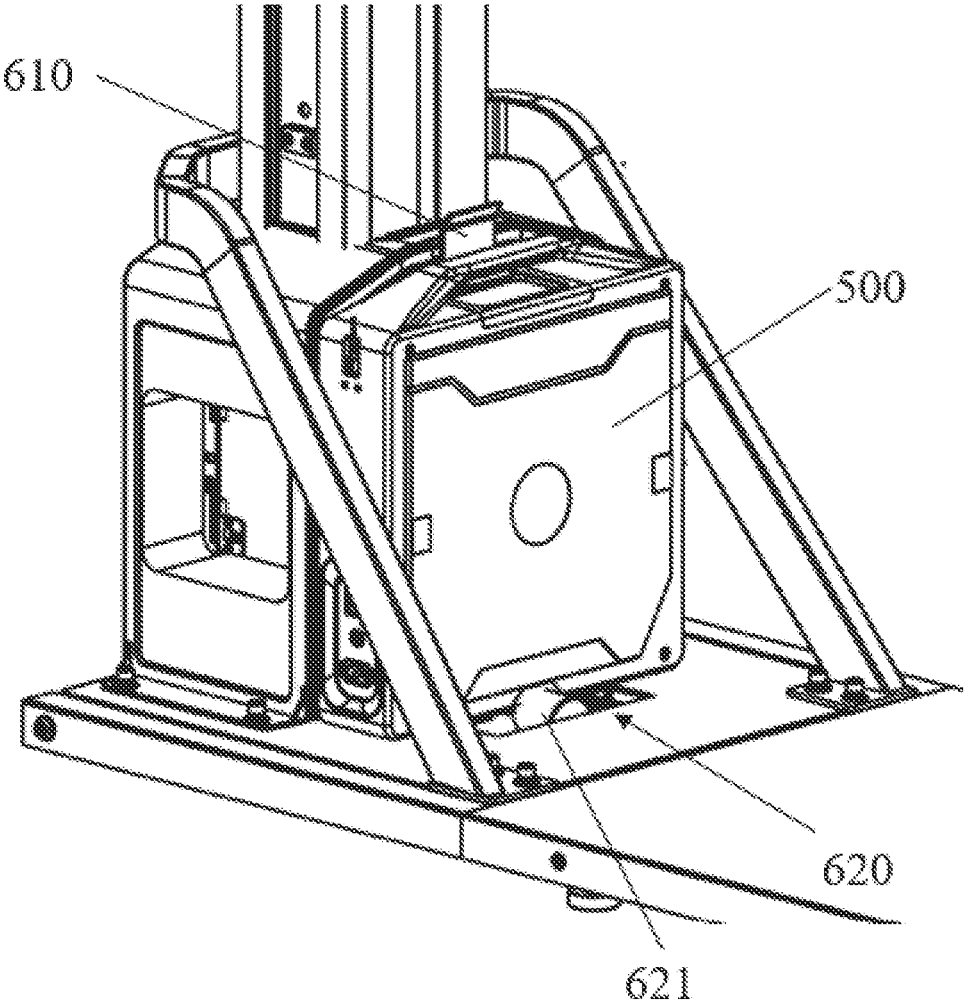
FIG. 14 is a structural diagram illustrating an exemplary mounting structure according to some embodiments of the present disclosure.
Figure 15A:
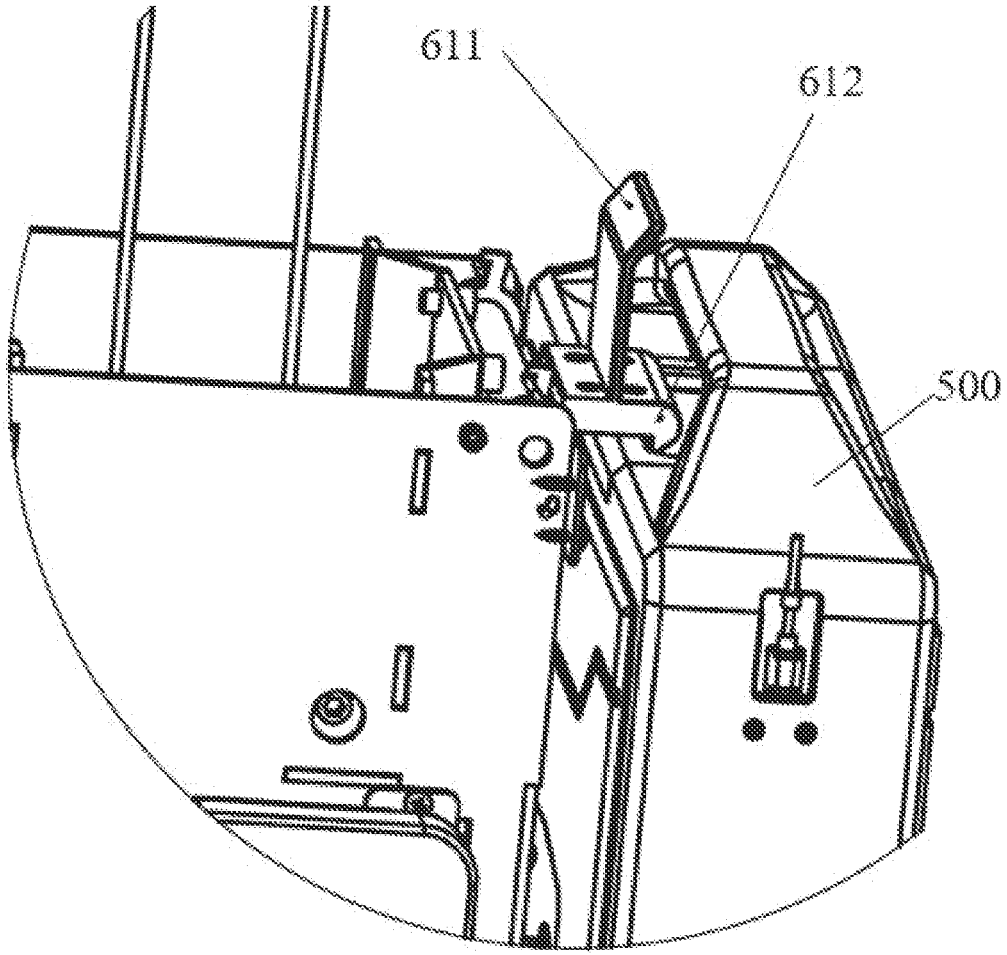
FIG. 15A is a structural diagram illustrating an exemplary first positioning assembly according to some embodiments of the present disclosure.
Figure 15B:
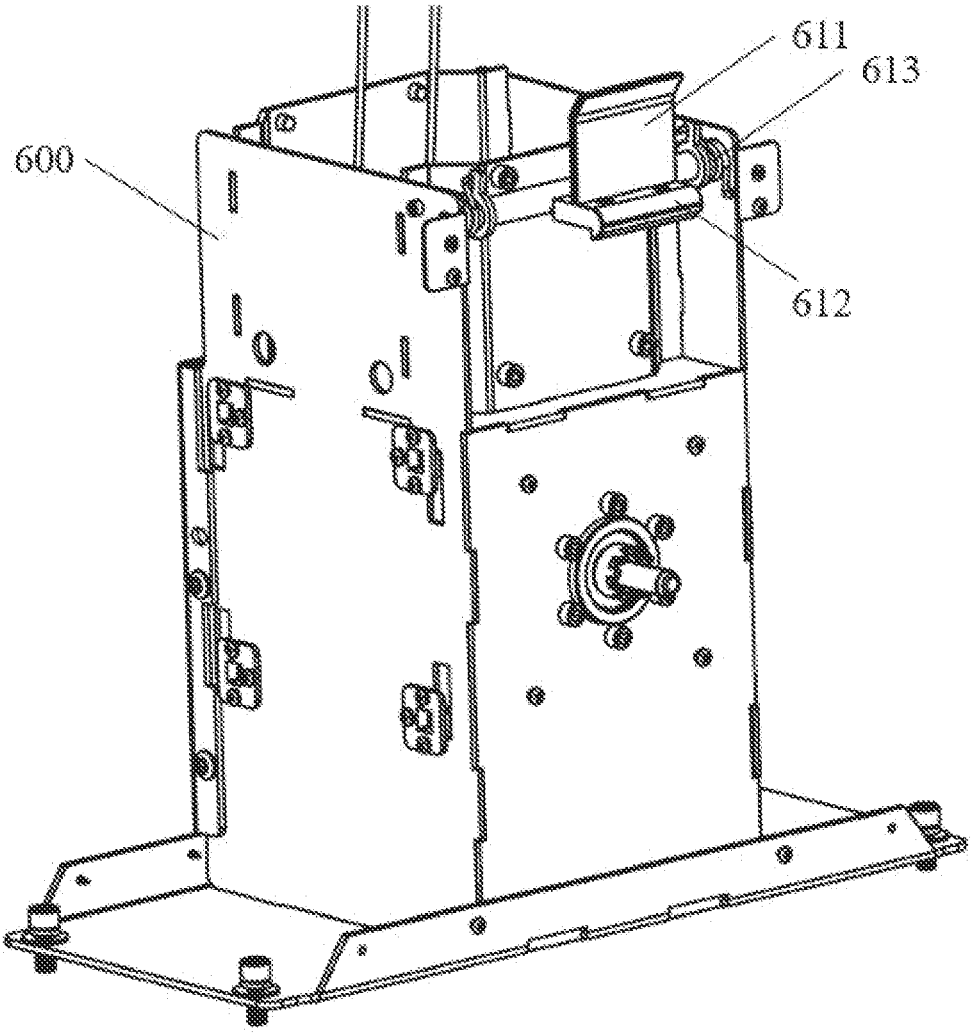
FIG. 15B is a structural diagram illustrating another exemplary first positioning assembly according to some embodiments of the present disclosure.
Figure 15C:
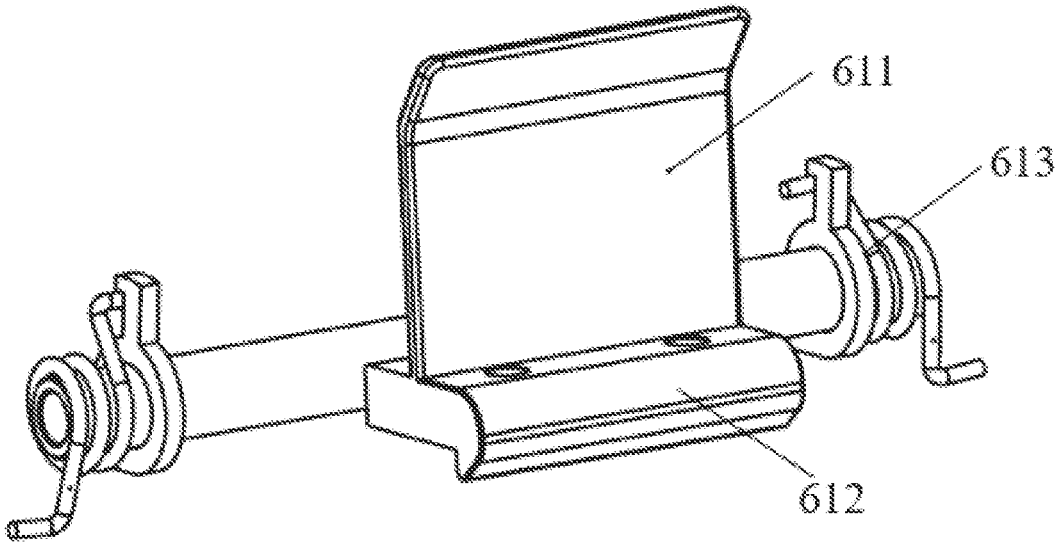
FIG. 15C is a structural diagram illustrating another exemplary first positioning assembly according to some embodiments of the present disclosure.

FIG. 13 is a structural diagram illustrating an exemplary resistance module and another fitness equipment according to some embodiments of the present disclosure. FIG. 14 is a structural diagram illustrating an exemplary mounting structure according to some embodiments of the present disclosure. FIG. 15A is a structural diagram illustrating an exemplary first positioning assembly according to some embodiments of the present disclosure. FIG. 15B is a structural diagram illustrating another exemplary first positioning assembly according to some embodiments of the present disclosure. FIG. 15C is a structural diagram illustrating another exemplary first positioning assembly according to some embodiments of the present disclosure.

In some embodiments, as shown in FIG. 13 and FIG. 14, the mounting structure may include a first positioning assembly 610 and a second positioning assembly 620. As shown in FIGS. 15A-15C, the first positioning assembly 610 may include an L-shaped platen 611. An end of a transverse plate of the L-shaped platen 611 may be provided with a snap hook structure 612 for hooking the resistance module 500 to prevent the resistance module 500 from moving outwardly. The transverse plate of the L-shaped platen 611 may abut the resistance module 500, so that the resistance module 500 may not move upward. A longitudinal plate of the L-shaped platen 611 may be used for easy user lifting. In some embodiments, the L-shaped platen 611 may be provided with a torsion spring 613. A downward force may be applied to the transverse plate of the L-shaped platen 611 by an elastic force of the torsion spring 613, which may further press down the resistance module 500. In some embodiments, when the user pulls the L-shaped platen 611 upward, the snap hook structure 612 may be lifted upwardly at an angle to separate from the resistance module 500.

Figure 16A:
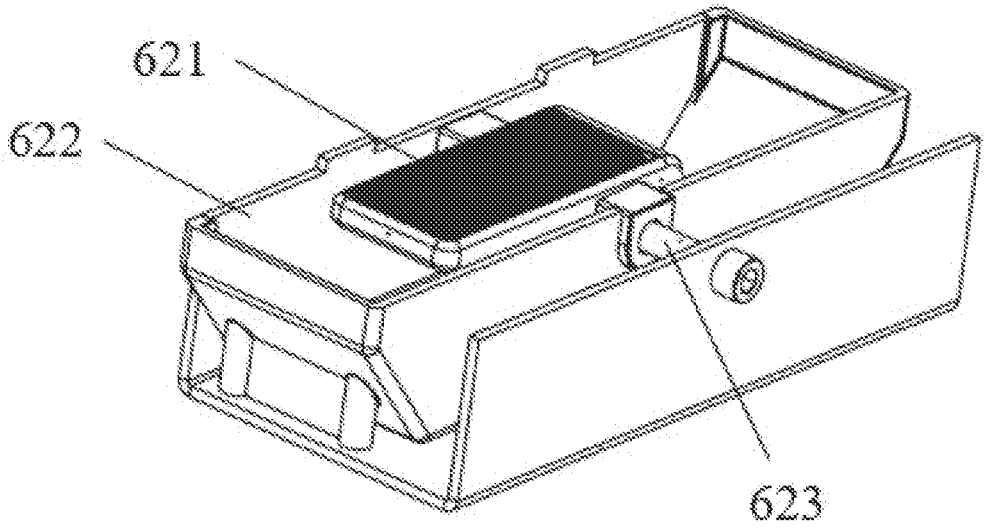
FIG. 16A is a structural diagram illustrating an exemplary second positioning assembly according to some embodiments of the present disclosure.
Figure 16B:
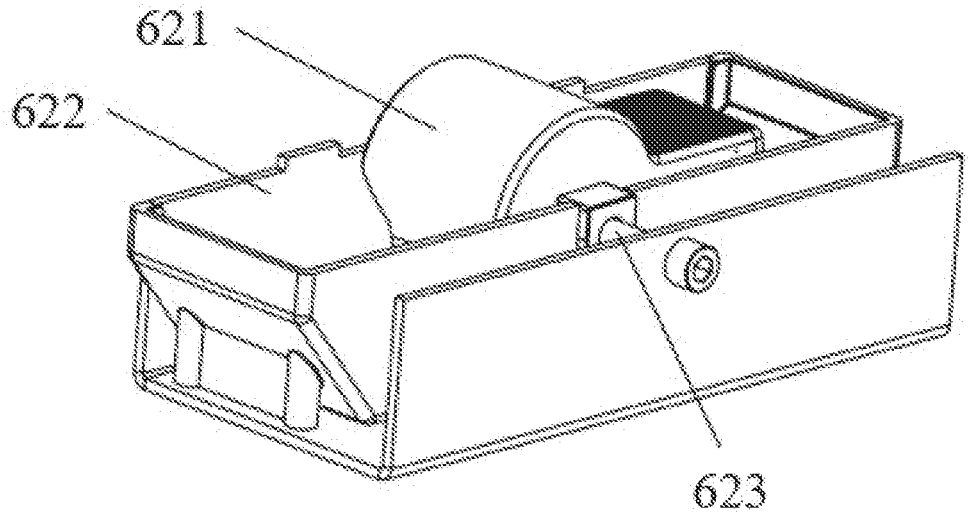
FIG. 16B is a structural diagram illustrating another exemplary second positioning assembly according to some embodiments of the present disclosure.
Figure 16C:
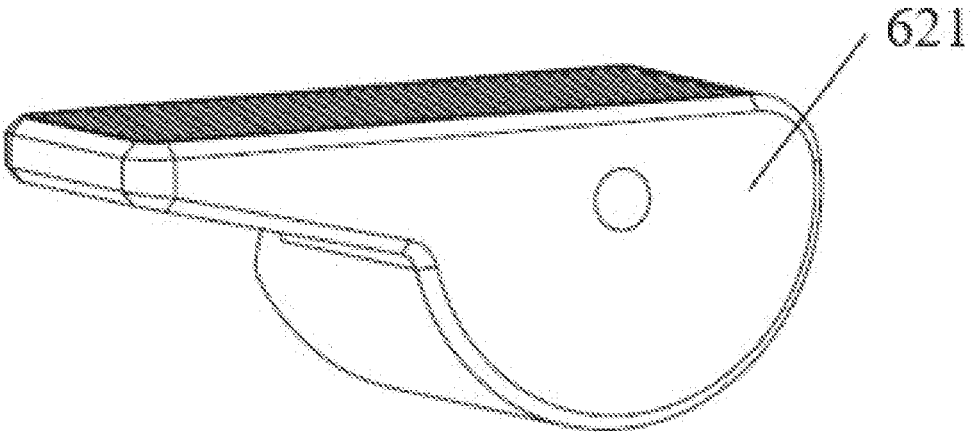
FIG. 16C is a structural diagram illustrating an exemplary convex plate according to some embodiments of the present disclosure.

FIG. 16A is a structural diagram illustrating an exemplary second positioning assembly according to some embodiments of the present disclosure. FIG. 16B is a structural diagram illustrating another exemplary second positioning assembly according to some embodiments of the present disclosure. FIG. 16C is a structural diagram illustrating an exemplary convex plate according to some embodiments of the present disclosure.

As shown in FIG. 16A to FIG. 16C, the second positioning assembly 620 may include a convex plate 621 and a mounting groove 622. One side of the convex plate 621 may be a flat surface, and another side of the convex plate 621 may have a protrusion (as shown in FIG. 16C). The convex plate 621 may be rotatably disposed in the mounting groove 622. For example, the convex plate 621 may be provided with a pin shaft 623, and both ends of the pin shaft 623 may be fixed in the mounting groove 622, so that the convex plate 621 may be rotated based on the pin shaft 623.

In some embodiments, the convex plate 621 shown in FIG. 16A may be rotated until the flat surface of the convex plate 621 is coplanar with a surface including a notch of the mounting groove 622, and may remain stable in the state when not subjected to a force pushing the convex plate 621 to rotate. At this time, the fitness equipment 600 may be not mounted with the resistance module 500 or the resistance module 500 may be not limited. In some embodiments, under the effect of gravity distribution of the convex plate 621 (i.e., the side having the protrusion may have a greater weight), the convex plate 621 may maintain a state in which the flat surface of the convex plate 621 is coplanar with the surface including the notch of the mounting groove 622.

In some embodiments, as shown in FIG. 16B, the convex plate 621 may be rotated by a force until the convex plate 621 protrudes beyond the surface including the notch of the mounting groove 622, and may remain stable in the state without being subjected to the force pushing the convex plate 621 to rotate. At this time, the resistance module 500 may be stuck by the protrusion of the convex plate 621 to achieve a stable mounting (see FIG. 14). In some embodiments, since the resistance module 500 is stuck by the protrusion of the convex plate 621, the convex plate 621 may maintain a state protruding beyond the surface including the notch of the mounting groove 622.

In some embodiments, the second positioning assembly 620 may further include a small motor (not shown). The small motor may be connected with the convex plate 621 so as to drive the convex plate 621 to rotate, so that the user may not need to manually operate. The user may operate the second positioning assembly 620 by controlling the small motor, which is more convenient.

In some embodiments of the present disclosure, the mounting structure may be disposed on the fitness equipment that matches the resistance module, so that the resistance module may be relatively fixed to the fitness equipment, thereby ensuring that the resistance module is in good contact with the fitness equipment during operation, and the resistance is transmitted to the fitness equipment better.

In some embodiments, the resistance module 500 may further include one or more position sensors. The one or more position sensors may be configured to monitor whether the resistance module 500 reaches a preset mounting position. For example, the one or more position sensors may include a first position sensor and a second position sensor. The first position sensor may be disposed on the resistance module 500 for monitoring a position of the transmission mechanism 530. The second position sensor may be disposed on the fitness equipment for monitoring a position of the mounting structure. In some embodiments, the one or more position sensors may include a third position sensor for recognizing a type of fitness equipment connected with the resistance module 500. Types of the one or more position sensors may include, such as a capacitive sensor, a displacement sensor, a grating sensor, a position encoder, etc. In some embodiments, the one or more position sensors may be communicatively connected with the controller 523, and the controller 523 may perform further processing based on a monitoring result of the one or more position sensors.

In some embodiments, the first position sensor and the third position sensor may be Hall sensors. A Hall sensor may be disposed at different positions of different fitness equipment. The Hall sensor may detect the position. The controller 523 may recognize the type of fitness equipment to which the resistance module 500 is connected through the detected position. For example, the controller 523 may recognize whether the fitness equipment connected with the resistance module 500 is a strength training station or a rowing machine based on the detected position.

In some embodiments, the resistance module 500 may further include an interactive screen. The interactive screen may facilitate communication between a user and components of the fitness equipment. For example, the user may interact with (e.g., control) the resistance module 500 or the fitness equipment by touching a screen, clicking a button, typing text, dragging an icon, etc. In some embodiments, the interactive screen may be disposed on at least one of the resistance module 500 or the fitness equipment. In other embodiments, the interactive screen may be a smart device (e.g., smartphone or smartwatch), and the smart device may be communicatively connected with either the resistance module 500 or the fitness equipment 600.

In some embodiments, the resistance module 500 may further include a distance sensor. The distance sensor may be configured to monitor a distance between an end face of the connecting shaft 531 and an end face of a rotating shaft of a gantry of the fitness equipment.

In some embodiments, the controller 523 may provide a reminder on the interactive screen indicating that the connecting shaft 531 is not mounted in place in response to the recognized type of the fitness equipment 600 to which the resistance module 500 is connected, and the distance between the end face of the connecting shaft 531 and the end face of the rotating shaft of the gantry of the fitness equipment denoted by distance sensor data does not satisfy a preset condition. In some embodiments, the controller 523 may, in response to the reminder indicating that the connecting shaft 531 is not mounted in place, display a corresponding mounting video or a scale position on the taper structure, etc., on the interactive screen to help the user to mount. In some embodiments, the controller 523 may repeatedly monitor the distance sensor data based on a preset time interval until the distance between the end face of the connecting shaft 531 and the end face of the rotating shaft of the gantry of the fitness equipment meets the preset condition. The preset condition may be that the distance between the end face of the connecting shaft 531 and the end face of the rotating shaft of the gantry of the fitness equipment 600 is smaller than a distance threshold. The distance threshold may be preset empirically, and the distance threshold may be 0, 1 centimeter, 2 centimeters, etc.

In some embodiments, the controller 523 may, in response to determining that detection data of the first position sensor and detection data of the second position sensor satisfy a preset condition, determine and prompt that the resistance module 500 has reached the preset mounting position; and send, based on the determination that the resistance module 500 has reached the preset mounting position, an activation command to activate the power device 520 of the resistance module 500. In some embodiments, the controller 523 may, in response to determining that the detection data of the first position sensor and the detection data of the second position sensor detection data do not satisfy the preset condition, determine and prompt specific content (e.g., a component and a position that are not mounted in place) that does not satisfy the preset condition; and provide mounting guidance based on the specific content that does not satisfy the preset condition. For example, the controller 523 may display a mounting video of the corresponding component on the interactive screen based on the specific content that does not satisfy the preset condition. The preset condition may be preset based on experience or historical data. For example, if current detection data of the first position sensor and current detection data of the second position sensor is consistent with detection data of the first position sensor and detection data of the second position sensor corresponding to the historical data when the resistance module 500 has been mounted in place, the preset condition may be considered to be satisfied.

In some embodiments, the controller 523 may, in response to determining that the fitness equipment is changed or replaced by another fitness equipment (e.g., the resistance module 500 is separated from a certain fitness equipment and close to or connected with another fitness equipment), provide mounting guidance of the resistance module 500 of the replaced fitness equipment or fitness training guidance, etc., on the interactive screen.

In some embodiments of the present disclosure, the position sensor, the distance sensor, and the interactive screen may be disposed, which may help the user to determine the type of the connected fitness equipment, and guide the user to mount the fitness equipment in a timely manner, thereby providing the user with convenience of mounting. At the same time, the controller 523, by determining the position sensor data and the distance sensor data, may fully ensure that the resistance module is reliably mounted and reliably positioned before activating the resistance module, which can ensure the safety of the user using the resistance module.

In some embodiments, the position sensor may include a fourth position sensor for monitoring the status data of the fitness equipment. In some embodiments, when the fitness equipment is a strength training station, the status data may include a position of a rotating shaft arm of the strength training station and an exercise program corresponding to the fitness equipment, a speed at which a pull rope is pulled out, a length that the pull rope is pulled out, etc. In some embodiments, when the fitness equipment is a rowing machine, the status data may include an exercise program of the rowing machine, a speed at which a pull rope is pulled out, a length that the pull rope is pulled out, etc. The exercise program refers to exercise data related to exercise. The exercise data may include a fitness parameter, an exercise duration, an effective exercise duration, etc. More descriptions regarding the exercise data may be found below.

In some embodiments, the controller 523 may provide a reminder for changing the exercise program in response to determining that the status data exceeds a preset value, and cause the resistance module 500 to change the resistance. In some embodiments, power device parameters (e.g., a speed or an output power) of the resistance module 500 corresponding to different training modes may be different, and the power device parameters corresponding to the different training modes may be preset values. In some embodiments, the controller 523 may obtain the power device parameters in advance based on a switching sequence of the training modes in the history records.

In some embodiments, the controller 523 may activate the resistance module 500 based on a power device parameter in response to determining that the motor assembly stops rotating when the fitness equipment is switched or after the fitness equipment 600 is switched. In some embodiments, the preset condition may need to be met before the resistance module 500 is activated. More descriptions regarding the preset condition that needs to be met before activation of the resistance module 500 may be found above.

In some embodiments, the controller 523 may collect, in response to determining that the resistance module 500 is connected with one of at least one set of fitness equipment exercise data of the user based on the fitness equipment, determine a recommended fitness parameter, and display the recommended fitness parameter on the interactive screen. The at least one set of fitness equipment refers to one or more different fitness equipment that may be connected with the resistance module 500. The exercise data may include a fitness parameter, an exercise duration, etc. The fitness parameter may include a parameter such as a tensile force, a torque force, or resistance of the fitness equipment.

In some embodiments, the resistance module 500 may be connected with different fitness equipment, the controller 523 may obtain exercise data corresponding to the fitness equipment connected with the resistance module 500. In some embodiments, the exercise data may include an exercise duration and an effective exercise duration. The exercise duration refers to a time spent by the user doing exercise using the fitness equipment. The effective exercise duration refers to a time spent by the user doing exercise with a relatively good result. In some embodiments, the effective exercise duration may be a duration when the resistance is output by the resistance module 500, which may exclude a case where the resistance module 500 runs but not outputs resistance.

In some embodiments, after the resistance module 500 is connected with the fitness equipment, the controller 523 may determine the effective exercise duration based on exercise intensity data corresponding to the fitness equipment. In some embodiments, the effective exercise duration may be obtained based on the exercise duration through weighting. If an exercise intensity is a standard exercise intensity, a weight may be 1. If the exercise intensity is smaller than the standard exercise intensity, the weight may be smaller than 1. If the exercise intensity is greater than the standard exercise intensity, the weight may be greater than 1. The exercise intensity data is used to indicate the exercise intensity, which reflects the amount of force exerted by the user, and the physical tension degree of the user, etc., during the exercise. The exercise intensity data may include an activation time of the fitness equipment recorded by the fitness equipment, an activation time of the resistance module 500, data such as resistance output by the resistance module 500 at different time points, power consumption, etc. In some embodiments, the standard exercise intensity may be associated with a user feature. For example, the standard exercise intensity may be lowered for a beginner and raised for a regular exerciser. In some embodiments, the standard exercise intensity may be set by a user for using the fitness equipment. In some embodiments, the standard exercise intensity may be related to a count of times the resistance module 500 has been switched in a previous preset time period and a historical effective exercise duration of the user. For example, if the user has switched the resistance module 100 three times in the past one hour, and the effective exercise duration is close to 20 minutes after each switch, it may indicate that the user is serious about the exercise, and the standard exercise intensity may be lowered when the user does exercise subsequently, so that a longer effective exercise duration may be recorded for the user.

In some embodiments of the present disclosure, by recording the exercise data of different fitness equipment connected by the resistance module, the exercise data of the user exercising in different fitness equipment may be obtained, so as to better personalize the exercise of the user and meet exercise needs of the user.

In some embodiments, the controller 523 may display the recommended fitness parameter to the user on the interactive screen based on the exercise data. The exercise data may include exercise data obtained through historical statistics (also referred to as historical exercise data) and currently recorded exercise data (also referred to as current exercise data). The recommended fitness parameter may include a parameter such as a tensile force, a torque force, resistance of fitness equipment, etc., recommended to the user. In some embodiments, the recommended fitness parameter of the resistance module 500 may be gradual increased in intensity. The intensity of the recommended fitness parameter of the resistance module 500 may stop increasing until the effective exercise duration varies by a magnitude that is smaller than a preset time threshold or decreases (indicating that the current exercise intensity may be too high relative to the user).

In some embodiments, the recommended fitness parameter may be related to the effective exercise duration of the user and a standard exercise duration. In some embodiments, the standard exercise duration may be related to the user feature (e.g., a user feature that is recorded when the user logs in). For example, if the effective exercise duration of the user is smaller than the standard exercise duration, the exercise intensity of the recommended fitness parameter may be reduced, and a reduced percentage may be equal to a ratio of the effective exercise duration to the standard exercise duration). If the effective exercise duration of the user is greater than the standard exercise duration, the exercise intensity may be increased in the recommended fitness parameter, and an increased percentage may be equal to a ratio of the effective exercise duration to the standard exercise duration. In some embodiments, the recommended fitness parameter may be no longer adjusted when a difference between two adjacent effective exercise durations of the user is smaller than a threshold.

In some embodiments of the present disclosure, the recommended fitness parameter of the user may be continuously optimized, which may improve a matching degree between the recommended fitness parameter and the user, so as to improve the exercise effect of the user, and at the same time to avoid exercise injuries to the user due to an excessive exercise intensity.

In some embodiments, the controller 523 may, in response to determining that the resistance module 500 is connected with the fitness equipment, predict an optimal fitness parameter of the user through a fitness parameter prediction model and send the optimal fitness parameter to the interactive screen for display. The optimal fitness parameter refers to a fitness parameter that has a highest matching degree with the user.

In some embodiments, the fitness parameter prediction model may be a machine learning model. For example, the fitness parameter prediction model may include a convolutional neural network (CNN) model, a neural network (NN) model, other customized model structure, or the like, or any combination thereof.

An input of the fitness parameter prediction model may include the user feature, the type of the current fitness equipment, and a candidate fitness parameter. The controller may recognize the type of the fitness equipment and input the type of the fitness equipment into the fitness parameter prediction model. An output of the fitness parameter prediction model may include a recommendation degree of the candidate fitness parameter. The user feature may be obtained when the user logs in online through a terminal, for example, the user feature may be inputted by the user voluntarily. The candidate fitness parameter may be one of a plurality of sets of fitness parameters determined by matching through a predetermined fitness parameter database based on the user feature and the current fitness equipment. For example, the controller 523 may construct a retrieval vector (e.g., {User feature 1, fitness equipment A}) based on the user feature and the current fitness equipment, retrieve in a fitness parameter vector database, and select a fitness parameter corresponding to a standard vector that has a closest distance (e.g., cosine distance) with the retrieval vector as the candidate fitness parameter. The fitness parameter vector database may be a vector database established by collecting historical data to construct vectors.

In some embodiments, the controller 523 may generate, based on a count of times the fitness equipment during a recent time period, a type of fitness equipment that is replaced each time, and the effective exercise duration corresponding to each replacement, sequence data, and match the candidate fitness parameter based on the sequence data. For example, if the user does exercise using only a fixed type of fitness equipment every day, as the exercise proceeds, the user may need a greater exercise intensity, and at this time, the intensity of the candidate fitness parameter subsequently may be appropriately increased. As another example, if the effective exercise duration of the user is relatively long before the fitness equipment is switched, and when the user switches the fitness equipment, the candidate fitness parameter subsequently may be appropriately reduced to avoid excessive fatigue of the user. The recommendation degree of the candidate fitness parameter refers to a degree to which the candidate fitness parameter matches the user, and the recommendation degree of the candidate fitness parameter may be expressed in a way, for example, the recommendation degree may be expressed as 0-100%.

In some embodiments, the fitness parameter prediction model may be obtained by training a plurality of training samples with labels. For example, the plurality of training samples with the labels may be input into an initial fitness parameter prediction model, a loss function may be constructed based on the labels and output results of the initial fitness parameter prediction model, and parameters of the initial fitness parameter prediction model may be iteratively updated through gradient descent or other manner based on the loss function. The model training may be completed when a preset condition is met, and a trained fitness parameter prediction model may be obtained. The preset condition may be that the loss function converges, a count of iterations reaches a threshold, etc.

In some embodiments, the training sample may at least include a sample user feature, a sample current fitness equipment, and a sample candidate fitness parameter. The label may be a recommendation degree corresponding to the sample candidate fitness parameter. In some embodiments, the controller 523 may obtain the label in various ways. For example, the controller 523 may obtain feedback from the user on the interactive screen after the exercise is completed (e.g., an active pop-up evaluation page) and determine the label based on the feedback. As another example, based on a large amount of historical data, if the difference between two adjacent effective exercise durations of the user is smaller than the threshold, it may indicate that the current fitness parameter is appropriate (also referred to as an appropriate fitness parameter). When the label is obtained through the feedback of the user on the interactive screen, it may be considered that the label of the current fitness parameter corresponding to the good comment is 1, and the label of the current fitness parameter corresponding to the bad or neutral comment is 0. When the label is obtained based on historical data, it may be considered that the label of an appropriate fitness parameter is 1 and the label of an inappropriate fitness parameter is 0.

In some embodiments, the controller 523 may use a candidate fitness parameter with a highest recommendation degree as the optimal fitness parameter displayed to the user based on the recommendation degree of the candidate fitness parameter output by the fitness parameter prediction model. In some embodiments, the controller 523 may also recommend a plurality of candidate fitness parameters in a sequential order, and note a candidate fitness parameter with a relatively low recommendation degree at the bottom of the ordering may be noted as a reminder such as "intensity may be too low," or "there may be a risk of strain" to further satisfy the choice of the user.

In some embodiments of the present disclosure, the optimal fitness parameter may be determined, and the optimal parameter may be combined with the user feature, thereby further obtaining the exercise program that matches the user and improving the exercise effect of the user.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements and amendments to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. In addition, some features, structures, or features in the present disclosure of one or more embodiments may be appropriately combined.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure does not mean that the present disclosure object requires more features than the features mentioned in the claims. Rather, claimed subject matter may lie in less than all features of a single foregoing disclosed embodiment.

In some embodiments, the numbers expressing quantities or properties used to describe and claim certain embodiments of the present disclosure are to be understood as being modified in some instances by the term "about," "approximate," or "substantially." For example, "about," "approximate," or "substantially" may indicate±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the present disclosure are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the present disclosure disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A fitness device, comprising:

a resistance module; and at least one type of fitness equipment, wherein the resistance module is detachably connected with the at least one type of fitness equipment, the resistance module provides resistance to the at least one type of fitness equipment, the resistance module includes a housing, a power device, and a transmission mechanism, the transmission mechanism includes a connecting shaft, the connecting shaft is configured to drivingly connect the at least one type of fitness equipment, and the power device provides the resistance to the at least one type of fitness equipment through the connecting shaft.

2. The fitness device of claim 1, wherein one of the at least one type of fitness equipment includes a switching device configured to switch a training mode of the one of the at least one type of fitness equipment, and the switching device includes a switching mechanism, a first connecting mechanism, and a second connecting mechanism;

the switching mechanism is drivingly connected with the first connecting mechanism or the second connecting mechanism;

a connection between the first connecting mechanism and the switching mechanism makes the fitness equipment drivingly connected with a resistance module, the switching device is in a first state, and the at least one type of fitness equipment is in a first mode; and a connection between the second connecting mechanism and the switching mechanism makes the fitness equipment drivingly connected with the resistance module, the switching device is in a second state, and the at least one type of fitness equipment is in a second mode.

3. The fitness device of claim 2, wherein the switching mechanism includes at least one toggle assembly, each of the at least one toggle assembly includes a support and a toggle member slidably disposed in the support, and the toggle member is drivingly connected with the first connecting mechanism or the second connecting mechanism by sliding on the support.

4. The fitness device of claim 3, wherein the support includes one or more positioning shafts; the one or more positioning shafts include a first positioning shaft and a second positioning shaft, the first positioning shaft is spaced apart from the second positioning shaft in an x-axis direction, and the first positioning shaft and the second positioning shaft is spaced apart in a y-axis direction; and the first positioning shaft includes a pair of first positioning sub-shafts coaxially disposed in a z-axis direction, and the second positioning shaft includes a pair of second positioning sub-shafts coaxially disposed in the z-axis direction; and the toggle member is slidably connected with the first positioning shaft and the second positioning shaft; and the toggle member moves in the x-axis direction and the y-axis direction simultaneously when the toggle member slides along at least one of the first positioning shaft and the second positioning shaft.

5. The fitness device of claim 4, wherein the toggle member includes a moving sleeve and a connecting member; and the moving sleeve is provided with a Z-groove, and the first positioning shaft and the second positioning shaft are able to slide in the Z-groove;

the connecting member is drivingly connected with the first connecting mechanism and the switching device is in the first state when both the first positioning shaft and the second positioning shaft are located in the Z-groove; or the connecting member is drivingly connected with the second connecting mechanism and the switching device is in the second state when the second positioning shaft is located in the Z-groove.

6. The fitness device of claim 5, wherein the first connecting mechanism includes a central gear assembly and a bevel gear, and the central gear assembly includes a fixed gear; and the switching device is in the first state by the toggle member sliding towards a first position for driving, through the connecting member, the bevel gear to mesh with the fixed gear.

7. The fitness device of claim 5, wherein the second connecting mechanism includes a unidirectional wheelset, and the unidirectional wheelset includes a unidirectional gear; and the switching device is in the second state by the toggle member sliding toward a second position for driving the connecting member to mesh with the unidirectional gear.

8. The fitness device of claim 2, further comprising a pull wheel assembly, wherein when the switching device is in the first state, the resistance module is drivingly connected with the pull wheel assembly through the first connecting mechanism; or when the switching device is in the second state, the resistance module is drivingly connected with the pull wheel assembly through the second connecting mechanism.

9. The fitness device of claim 1, wherein a handle is disposed outside the housing, a fixed plate is disposed inside the housing, the power device and the transmission mechanism are mounted on the fixed plate, and a cooling fan is disposed on the fixed plate.

10. The fitness device of claim 1, wherein the power device includes a motor assembly, a resistor, and a controller.

11. The fitness device of claim 1, wherein the power device includes a power source.

12. The fitness device of claim 1, wherein the transmission mechanism includes a positioning shaft, and the connecting shaft is concentric with a rotating shaft of a gantry of one of the at least one type of fitness equipment through the positioning shaft.

13. The fitness device of claim 1, further comprising a taper structure, wherein the taper structure is disposed outside the connecting shaft; and the taper structure matches a mating structure disposed on the fitness equipment to make the connecting shaft concentric with a rotating shaft of a gantry of one of the at least one fitness equipment.

14. The fitness device of claim 1, further comprising a position sensor, wherein the position sensor is configured to monitor whether the resistance module reaches a preset mounting position.

15. The fitness device of claim 1, further comprising a distance sensor, wherein the distance sensor is configured to monitor a distance between an end face of the connecting shaft and an end face of a rotating shaft of a gantry of one of the at least one type of fitness equipment.

16. The fitness device of claim 1, further comprising a mounting structure configured to mounting the resistance module, wherein the mounting structure is disposed on each of the at least one type of fitness equipment, and the resistance module is fixed relative to one of the at least one type of fitness equipment through the mounting structure.

17. The fitness device of claim 16, wherein the mounting structure includes a first positioning assembly and/or a second positioning assembly;

the first positioning assembly includes an L-shaped platen, an end of a transverse plate of the L-shaped platen is provided with a snap hook structure for hooking the resistance module, and the L-shaped platen is provided with a torsion spring; and the second positioning assembly includes a convex plate and a mounting groove, one side of the convex plate is a flat surface, and another side of the convex plate has a protrusion; and the convex plate is rotatably disposed in the mounting groove to make the flat surface of the convex plate coplanar with a surface including a notch of the mounting groove, or the convex plate protrudes beyond the surface including the notch of the mounting groove.

18. A method for switching a training mode, applied to a fitness device, including a physiological monitoring device and a motion monitoring device; and the method comprises:

extracting a motion feature of a user based on motion data obtained by the motion monitoring device, wherein the motion feature includes a sequence including a frequency of a target behavior per unit of time, time consumption of the target behavior, and a stability degree of the target behavior, and the stability degree of the target behavior is used to characterize a stability degree of a strength or a speed of the user during training;

determining a motion state of the user based on physiological monitoring data obtained by the physiological monitoring device and the motion feature; and determining whether to switch a training mode of one of at least one type of fitness equipment of the fitness device based on the motion state.

19. A fitness device, comprising:

a switching device configured to switch a training mode of the one of the at least one type of fitness equipment, the switching device including a switching mechanism, a first connecting mechanism, and a second connecting mechanism;

the switching mechanism is drivingly connected with the first connecting mechanism or the second connecting mechanism;

a connection between the first connecting mechanism and the switching mechanism makes the fitness equipment drivingly connected with a resistance module, the switching device is in a first state, and the at least one type of fitness equipment is in a first mode; and a connection between the second connecting mechanism and the switching mechanism makes the fitness equipment drivingly connected with the resistance module, the switching device is in a second state, and the at least one type of fitness equipment is in a second mode.

20. The method of claim 18, wherein the motion state includes a motion degree, and the method further comprises:

determining the motion degree based on a weighted sum of a first similarity degree and a second similarity degree;

determining the first similarity degree base on the physiological monitoring data and reference physiological data; and degerming the second similarity degree based on the motion feature and a reference motion feature.

* * * * *